US006294299B2

(12) United States Patent
Tsuchida et al.

(10) Patent No.: US 6,294,299 B2
(45) **Date of Patent: *Sep. 25, 2001**

(54) ELECTROPHOTOGRAPHIC LIGHT-RECEIVING MEMBER

(75) Inventors: Shinji Tsuchida, Kyotanabe; Hiroaki Niino, Nara; Satoshi Kojima, Kyotanabe; Daisuke Tazawa, Nara-ken, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/137,081

(22) Filed: Aug. 20, 1998

(30) Foreign Application Priority Data

Aug. 22, 1997 (JP) ..... 9-226621

(51) Int. Cl.[7] ..... G03G 15/02
(52) U.S. Cl. ..... 430/57.7; 430/65; 430/66
(58) Field of Search ..... 430/56, 57.7, 65, 430/50, 66

(56) References Cited

U.S. PATENT DOCUMENTS

| | | | |
|---|---|---|---|
| 4,265,991 | 5/1981 | Hirai et al. | 430/64 |
| 4,659,639 | 4/1987 | Mizumo et al. | 430/65 |
| 4,788,120 | 11/1988 | Shirai et al. | 430/66 |
| 4,863,820 | 9/1989 | Osawa | 430/65 |
| 4,882,251 | 11/1989 | Aoike et al. | 430/57.7 |
| 4,906,542 | 3/1990 | Aoike et al. | 430/57.6 |
| 4,906,543 | 3/1990 | Aoike et al. | 430/57.7 |
| 4,981,766 | 1/1991 | Aoike et al. | 430/57.6 |
| 5,382,487 | 1/1995 | Fukuda et al. | 430/65 |
| 5,514,506 | 5/1996 | Takai et al. | 430/57.7 |
| 5,738,963 | 4/1998 | Nino | 430/65 |

FOREIGN PATENT DOCUMENTS

| | | |
|---|---|---|
| 454456 | 10/1991 | (EP) . |
| 619526 * | 10/1994 | (EP) . |
| 718698 | 6/1996 | (EP) . |
| 809153 | 11/1997 | (EP) . |
| 829769 | 3/1998 | (EP) . |
| 115556 | 7/1982 | (JP) . |
| 88115 | 5/1983 | (JP) . |
| 95551 | 5/1985 | (JP) . |
| 168156 | 8/1985 | (JP) . |
| 178457 | 9/1985 | (JP) . |
| 225854 | 11/1985 | (JP) . |
| 231561 | 10/1986 | (JP) . |

* cited by examiner

*Primary Examiner*—Janis L. Dote
(74) *Attorney, Agent, or Firm*—Fitzpatrick, Cella, Harper & Scinto

(57) ABSTRACT

An electrophotographic light-receiving member has a conductive support and a photoconductive layer composed of a non-monocrystalline material comprising silicon atoms as a matrix, hydrogen and/or halogen atoms, and an element belonging to Group IIIb of the periodic table. The photoconductive layer has from the surface side toward the conductive support side, a third layer region that absorbs 50–90% of incident image exposure light and a second layer region that absorbs 60–90% of pre-exposure light incident on the photoconductive layer. The Group IIIb element is present such that its content decreases from the conductive support side to the surface side. In three embodiments the photoconductive layer has, respectively: 10–30 at. % H; 10–20 at. % H and 25–40 at % H; an optical band gap of 1.75–1.85 eV, 1.65–1.75 eV and 1.80–1.90 eV and a characteristic energy of each of 50–55 meV.

30 Claims, 5 Drawing Sheets

ELECTROPHOTOGRAPHIC LIGHT-RECEIVING MEMBER

BACKGROUND OF THE INVENTION

1. Field of the Invention

The present invention relates to an electrophotographic light-receiving member that is sensitive to electromagnetic waves such as light (that is light in a broad sense meaning ultraviolet rays, visible light, infrared rays, X rays, γ rays, or the like).

2. Related Background Art

In the field of image formation, a photoconductive material used to form a light-receiving layer in a light-receiving member is required to have such characteristics as high sensitivity, high SN ratio [photocurrent (Ip)/dark current (Id)], absorption spectrum compatible with the spectrum characteristic of radiated electromagnetic waves, quick photoresponse, and desired dark resistance value, no adverse affection for human beings in use, or the like. In particular, for light-receiving members integrated into electrophotographic apparatuses used as business machines in offices, the above mentioned non-polluting property is very important in use.

Photoconductive materials that are excellent in this point include hydrogenated amorphous silicon (hereafter referred to as "a-Si:H"), and its application as an electrophotographic light-receiving member is described in, for example, U.S. Pat. No. 4,265,991.

Such a light-receiving member is generally formed by heating a conductive support to 50–350° C. and forming a photoconductive layer comprised of a-Si on the support using a film formation method such as a vacuum evaporation method, a sputtering method, an ion plating method, a thermal CVD method, a photo CVD method, a plasma CVD method, and the like. In particular, the plasma CVD method that decomposes a source gas by a high frequency or microwave glow discharge to form an a-Si deposited film on the support is put to practical use as a preferable method.

In addition, U.S. Pat. No. 5,382,487 proposes an electrophotographic light-receiving member comprised of a conductive support and a photoconductive layer of a-Si containing halogen atoms as a constituent (hereafter referred to as "a-Si:X"). The patent reports that incoporating 1 to 40 atomic % of halogen atoms into a-Si provides high heat resistance and good electrical and optical characteriaticsthe for a photoconductive layer of an electrophotographic light-receiving member.

In addition, Japanese Patent Application Laid-Open No. 57-115556 describes a technique for providing on a photoconductive layer composed of an amorphous material containing silicon atoms as a host, a surface barrier layer composed of a non-photoconductive amorphous material containing silicon and carbon atoms, in order to improve electrical, optical, and photoconductive characteristics such as dark resistance value, photosensitivity, photoresponse, etc. and operating environment characteristics such as humidity resistance, etc. and to also improve aging resistance for a photoconductive member having a photoconductive layer composed of an a-Si deposited film. Furthermore, U.S. Pat. No. 4,659,639 describes a technique for a photosensitive member formed by stacking a light-transmissive insulating overcoat layer containing amorphous silicon, carbon, oxygen, and fluorine, and U.S. Pat. No. 4,788,120 describes a technique for using as a surface layer an amorphous material containing as constituents silicon and carbon atoms and 41–70 atomic % of hydrogen atoms.

Japanese Patent Application Laid-Open No. 62-83470 discloses a technique for setting to 0.09 eV or less the characteristic energy of the Urbach tail of an optical absorption spectrum of a photoconductive layer of an electrophotographic photosensitive member to obtain a high quality image free of the ghost phenomenon. In particular, Japanese Patent Application Laid-Open No. 58-88115 discloses that the support side of the photoconductive layer contains a larger amount of atoms belonging to Group IIIb in the periodic table in order to improve the image quality of an amorphous silicon photosensitive member, and Japanese Patent Application Laid-Open No. 62-112166 discloses a technique for generating a carrier transport layer while maintaining the flow ratio of $B_2H_6$ to $SiH_4$ at $3.3\times10^{-7}$ or more to prevent the ghost phenomenon.

In addition, to improve the image quality of an amorphous silicon photosensitive member, Japanese Patent Application Laid-Open No. 60-95551 discloses a technique that an image formation process such as charging, exposure, and development is carried out while maintaining the temperature near the surface of a photosensitive member at 30–40° C. to prevent decrease in surface resistance caused by adsorption of moisture at a surface of a photosensitive member and generation of image smearing accompanying the decrease.

These techniques have improved the electrical, optical, and photoconductive characteristics and operating environment characteristics of electrophotographic light-receiving members, which has also improved the image quality.

Although the conventional electrophotographic light-receiving members having a photoconductive layer composed of a-Si-based material have each been improved in their electrical, optical, and photoconductive characteristics such as a dark resistance value, photosensitivity, photoresponse, etc. and their operating environment characteristics, aging resistance, and durability, there is still room for improvement in the overall characteristics.

In particular, since the image quality, operation speed, and durability of the electrophotographic apparatus are improved rapidly, it is necessary to further improve the electrical and photoconductive characteristics of the electrophotographic light-receiving member and to significantly improve the performance in every environment while maintaining the chargeability and sensitivity.

Since the optical exposure device, developing device, and transfer device in the electrophotographic apparatus have been improved to improve the image characteristics of the apparatus, the electrophotographic light-receiving member is also required to have more improved image characteristics than the prior art.

In these circumstances, the above conventional techniques have enabled these characteristics to be improved to some degree, but have not sufficiently improved the chargeability or image quality in some cases. In particular, to further improve the image quality of amorphous silicon based light-receiving member, it is further required to reduce the variation of the electrophotograhic characteristics due to a change in ambient temperature and optical memory such as blank memory or ghost.

For example, in the prior art, to prevent the image smearing of a photosensitive member, a heater for heating the drum is installed in a copying machine to maintain the surface temperature of the photosensitive member at about 40° C. as described in Japanese Patent Application Laid-Open No. 60-95551 as mentioned above. However, in the prior art photosensitive members, the temperature dependence of chargeability resulting from the generation of pre-exposure carriers or thermally excited carriers, that is, the so-called temperature characteristic is large, so that they must be used with chargeability lower than its inherent chargeability in an actual operating environment in a copying machine. For example, when the drum is heated at about 40° C., the chargeability may sometimes be lowered by about 100 V compared to that in operation at room temperature.

In addition, in the past, even during night when the copying machine is not used, the drum heater has been supplied with power to prevent image smearing from occurring by adsorption of ozone products generated by corona discharge from a charging device to the surface of the photosensitive member during night. At present, however, every effort is made to avoid the power supply to the copying machines during night in order to save resources and power. When copying is carried out under such conditions, the ambient temperature of the photosensitive member in the copying machine gradually increases to lower the chargeability, thereby sometimes causing a phenomenon that the image density varies during copying.

Furthermore, when the same manuscript is repeatedly copied, the so-called ghost phenomenon may occur in which a ghost of an image exposure during the preceding copying process appears on the image during the current copying, or the blank memory may occur in which a difference in image density is generated on a copied image due influence of the so-called blank exposure provided to the photosensitive member between every paper for toner saving during a continuous copying process. These phenomena obstruct the improvement of the image quality.

On the other hand, the recent wide spread of use of computers in offices and homes requires the electrophotograhic apparatus to be digitalized to serve not only as a copying machine as in the past but also as a facsimile or printer. A semiconductor laser or an LED that is used as an exposure light source for such a digitalized apparatus mainly uses a relatively large wavelength ranging from near infrared radiation to red visible light due to its emission strength and costs. This results in the need to improve those aspects of the electrophotographic apparatus which are not taken into account for conventional analog apparatuses using halogen light.

In particular, the use of a semiconductor laser or LED is characterized by that the relationship between the exposure and the surface potential of the photosensitive member, i.e., the so-called E-V characteristic (curve) shifts depending on temperature (temperature characteristic of sensitivity), or that the E-V characteristic (curve) becomes dull to lower its linearity (linearity of sensitivity).

That is, in a digital apparatus using a semiconductor laser or LED as an exposure light source, there has been posed a problem that when the temperature of the photosensitive member is not controlled by the drum heater, then due to the temperature characteristic of sensitivity or the lowering in the linearity of sensitivity, the ambient temperature varies the sensitivity to also vary the image density.

Furthermore, with respect to the optical memory described above, there has been posed a new problem that since the wavelength of a semiconductor laser or LED used as an exposure light source ranges from near infrared radiation to red visible light and is relatively long, and therefore since light carriers are generated in a relatively deep place relative to the surface, as compared to the conventional analog apparatus, the photocarriers are thus likely to remain to generate optical memory.

Thus, in designing an electrophotographic light-receiving member, it is necessary to improve the layer configuration of the electrophotographic light-receiving member and the chemical composition of each layer from the standpoint of overall characteristics while further improving the characteristics of the a-Si material itself so as to solve the above problems.

SUMMARY OF THE INVENTION

It is an object of the present invention to solve the above mentioned various problems of the conventional electrophotographic light-receiving member having a light-receiving layer composed of a-Si.

It is another object of the present invention to provide an electrophotographic light-receiving member having a light-receiving layer composed of non-monocrystalline material comprising silicon atoms as a matrix, and having significantly improved image quality by simultaneously achieving, at high level, improvement of chargeability, and reduction of temperature characteristic and optical memory.

It is still another object of the present invention to provide an electrophotographic light-receiving member having a light-receiving layer composed of a non-monocrystalline material comprising silicon atoms as a matrix wherein the image quality is significantly improved by improving the temperature characteristic of sensitivity, the linearity of sensitivity and the optical memory when a semiconductor laser or an LED is used as an exposure light source.

It is yet another object of the present invention to provide an electrophotographic light-receiving member having a light-receiving layer composed of a non-monocrystalline material comprising silicon atoms as a matrix, which has substantially constantly stable electrical, optical and photoconductive characteristics having almost no dependency on the operating environment, is excellent in light-fatigue resistance, causes no deterioration phenomenon during repeated use and is excellent in durability and humidity resistance, has almost no residual potential observed, and provides good image quality.

According to the present invention, there is provided an electrophotographic light-receiving member comprising a conductive support; and a light-receiving layer provided on the conductive support and having a photoconductive layer composed of a non-monocrystalline material comprising silicon atoms as a matrix, hydrogen and/or halogen atoms, and an element belonging to Group IIIb of the periodic table, wherein the photoconductive layer has from the surface side toward the conductive support side, a third layer region that absorbs a specified range of amount of image exposure light incident on the photoconductive layer, a second layer region that is other than the third layer region of a layer region that absorbs a specified range of amount of pre-exposure light incident on the photoconductive layer, and a first layer region that is other than the third and the second layer regions of the photoconductive layer, and wherein the element belonging to Group IIIb of the periodic table is contained in the photoconductive layer such that the content of the element belonging to Group IIIb of the periodic table decreases in the order of the first, the second and the third layer regions.

Incidentally, in the electrophotographic light-receiving member which accomplishes the above mentioned objects, it is desirable that when the hydrogen content of the photoconductive layer is 10–30 atomic % and the optical band gap of the photoconductive layer is 1.75–1.85 eV, the characteristic energy of the Urbach tail obtained from an optical absorption spectrum of the photoconductive layer is 55–65 mev.

Further, in the electrophotographic light-receiving member which accomplishes the above mentioned objects, it is desirable that when the hydrogen content of the photoconductive layer is 10–20 atomic % and the optical band gap of the photoconductive layer is 1.65–1.75 eV, the characteristic energy of the Urbach tail obtained from an optical absorption spectrum of the photoconductive layer is 50–55 meV.

In addition, in the electrophotographic light-receiving member which accomplishes the above mentioned objects, it is desirable that when the hydrogen content of the photoconductive layer is 25–40 atomic t and the optical band gap of the photoconductive layer is 1.80–1.90 eV, the characteristic energy of the Urbach tail obtained from an optical absorption spectrum of the photoconductive layer is 50–55 meV.

The inventors have found that in order to optimize the member to a long-wavelength light (a laser or an LED) for use in digitization, particularly by taking into account the roles of a light incidence portion for photoelectric conversion, that is, a portion on which image exposure light and pre-exposure light are incident and the other portions, the content and distribution state of an element belonging to Group IIIb of the periodic table which is a material capable of controlling conductivity type can be controlled to accomplish the objects of improving the temperature characteristic of sensitivity, the linearity of sensitivity and the optical memory (ghost memory), and of improving the chargeability and temperature characteristic.

The term "Urbach tail" as used in the specification and claims refers to a tail of an optical absorption spectrum lying toward the low-energy side of the optical absorption spectrum. In addition, the term "characteristic energy" means the slope of the Urbach tail.

This is described in detail with reference to FIG. 1.

FIG. 1 shows an example of a subgap optical absorption spectrum of a-Si in which photon energy hv is indicated on the horizontal axis and absorption coefficient $\alpha$ is indicated on the vertical axis as a logarithmic axis. This spectrum is mostly divided into two parts, one being part B (Urbach tail) in which the absorption coefficient $\alpha$ varies exponentially, that is, linearly relative to photon energy $h\lambda$ and the other being part A in which $\alpha$ exhibits smaller dependency on hv.

The region B corresponds to optical absorption caused by optical transition from tail states on the valence electron band side to the conduction band in a-Si. The exponential dependency of the absorption coefficient $\alpha$ on hv in the region B is represented by the following equation.

$$\alpha=\alpha_0 \exp(h\nu/Eu)$$

The logarithms of both sides of the above equation are determined as follows.

$$\ln \alpha=(1/Eu)\cdot h\nu+\alpha 1$$

wherein $\alpha 1=\ln \alpha_0$, and the inverse (1/Eu) of the characteristic energy Eu indicates the slope of the part B. Since Eu corresponds to the characteristic energy of the exponential energy distribution of the tail states on the valence electron band side, smaller Eu means less tail states on the valence band side and a smaller trapping rate of carriers by localized states.

The temperature characteristic of sensitivity and the linearity of sensitivity used in this invention are described with reference to FIG. 2.

FIG. 2 shows an example of the E-V characteristic (curve), that is, the change in the surface potential (light potential) occurring when, at room temperature (drum heater off) and at about 45° C. (drum heater on), the photosensitive member is charged to have a surface potential of 400 V as a dark potential and then irradiated with 680 nm LED light as an exposure light source with various exposures.

The temperature characteristic of sensitivity is determined by a difference between the exposures (half-value exposures) measured at the room temperature and at about 45° C. when the difference between the dark potential and the light potential (potential under illumination) becomes 200 V ($\Delta$200).

In addition, the linearity of sensitivity is determined by a difference between the exposure (found value) when the difference between the dark potential and the light potential becomes 350 V ($\Delta$350) and the exposure (calculated value) when extrapolation is carried out using a straight line Joining a point at the state of no exposure (dark state) with a point at the state of irradiation with the half-value exposure to obtain $\Delta$350.

For either of the temperature characteristic of sensitivity and the linearity of sensitivity, a smaller value thereof means that the photosensitive member exhibits better characteristics.

The inventors studied under various conditions, the relationship between the absorbing regions of image exposure light and pre-exposure light and the content of an element belonging to Group IIIb of the periodic table which is a material capable of controlling the conductivity type. As a result, the inventors have found that excellent characteristics of the photosensitive-member can be obtained by defining for the image exposure light and the pre-exposure light absorbing regions, the content of an element belonging to Group IIIb of the periodic table, and further by defining the distribution state of the element belonging to Group IIIb such that the content of the element is larger on a side opposite to the incident-light side, and have completed the present invention.

Incidentally, the inventors further studied in detail the relationship between the characteristics of the photosensitive member; and an optical band gap (hereinafter referred to as "Eg") and the characteristic energy (hereinafter referred to as "Eu") of the Urbach tail determined from a subband gap optical absorption spectrum measured by the constant photocurrent method. As a result, the inventors have also found a close relationship between Eg and Eu; and the chargeability, temperature characteristic or optical memory of the a-Si photosensitive member.

In particular, to optimize the member to a long-wavelength laser, the inventors studied in detail, the balance of the transitting properties of holes and electrons in image exposure light and pre-exposure light incidence portions depending on the content and distribution state of the conductivity-type controlling material. As a result, the inventors have found that the content and distribution state of the conductivity-type controlling material have close relations with the temperature characteristic of sensitivity and the linearity of sensitivity. Furthermore, the inventors have found that they have also close relations with optical memory. That is, the inventors have found that excellent characteristics of the photosensitive member suitable for digitization can be obtained by controlling the content of the element belonging to Group IIIb of the periodic table relative to silicon atoms depending on the absorption depths of the image exposure light and pre-exposure light incidence portions, and by defining the distribution state of the element belonging to Group IIIb such that the content of the element is larger on a side opposite to the incident-light side, and have completed this invention.

Incidentally, the inventors also studied in detail, the relationship between Eg, Eu and the characteristics of the photosensitive member when a semiconductor laser or LED is used as an exposure light source. As a result, the inventors have found that Eg and Eu also have close relations with the temperature characteristic of sensitivity and the linearity of sensitivity. Furthermore, the inventors have found that they have also close relations with optical memory.

That is, the inventors have found that excellent characteristics of the photosensitive member suitable for digitization can be obtained by controlling the content of the element belonging to Group IIIb of the periodic table relative to silicon atoms depending on the absorption depths of the image exposure light and pre-exposure light incidence portions, and by defining the distribution state of the element belonging to Group IIIb such that the content of the element is larger on a side opposite to the incident-light side, and have completed this invention.

In addition, the inventors have also found that more excellent characteristics of the photosensitive member suitable for digitization can be obtained by controlling the content of the element belonging to Group IIIb of the periodic table relative to silicon atoms depending on the absorption depths of the image exposure light and pre-exposure light incidence portions and by defining the distribution state of the element belonging to Group IIIb such that the content of the element is larger on a side opposite to the incident-light side, and further by adjusting the Eg, Eu and hydrogen content of the photoconductive layer to values within specified ranges.

The inventors' experiments have shown that in a photoconductive layer, the content of an element belonging to Group IIIb of the periodic table relative to silicon atoms is controlled depending on the absorption depth of the image exposure light and pre-exposure light incidence portions, and the element belonging to Group IIIb of the periodic table is distributed such that the content of the Group IIIb element is larger on a side opposite to the incident-light side, whereby the temperature characteristic and linearity of sensitivity can be significantly improved, optical memory can be substantially eliminated, and the chargeability and temperature characteristic can be improved.

In addition, the inventors' experiments have also shown that in a photoconductive layer defined in the content of an element belonging to Group IIIb of the periodic table relative to silicon atoms depending on the absorption depth of the image exposure light and pre-exposure light incidence portions, and further defined in the distribution state of the element belonging to Group IIIb such that the content of the Group IIIb element is larger on a side opposite to the incident-light side, the hydrogen content, optical band gap, and trapping rate of carriers by localized states of the photoconductive layer are further defined, whereby the temperature characteristic and linearity of sensitivity can be more significantly improved, optical memory can further be substantially eliminated, and the chargeability and temperature characteristic can be more improved.

On the other hand, the inventors showed prior to the present invention that an excellent light-receiving member can be obtained by controlling the content of the element belonging to Group IIIb of the periodic table relative to silicon atoms in a photoconductive layer depending on the absorption depth of the image exposure light incidence portion and by distributing the Group IIIb element such that the content of the Group IIIb element is larger on a side opposite to the incident-light side. There are, however, still some points to be improved in comprehensively improving the overall characteristics. Thus, the inventors further energetically studied to optimize the member to a long-wavelength light (laser or LED) for digitization. As a result, the inventors have found that by designing the material taking into consideration not only the role of the portion on which the image exposure light is incident but also the role of the portion on which the pre-exposure light is incident, optical memory can be more appropriately improved to provide a light-receiving member suitable for digitalization.

Specifically describing the above, the tail level due to the structural disturbance of Si—Si binding and a deep level attributed to structural defects such as dangling bonds of Si are generally present in the band gap of a-Si:H. These levels are known to function as a center for capturing electrons and holes and conducting recombination to degrade the characteristics of the member.

Methods for measuring the localized states in the band gap generally include deep-level transient spectroscopy, isothermal capacitance transient spectroscopy, light-heat polarizing spectroscopy, light-sound spectroscopy, and the constant photocurrent method. In particular, the constant photocurrent method (hereinafter referred to as "CPM") is useful as a method for simply measuring a subgap optical absorption spectrum due to localized states of a-Si:H.

One of the causes of the degradation of the chargeability occurring when the photosensitive member is heated by the drum heater is that thermally excited carriers are drawn by electric fields generated during charging to travel on the surface while repeating to be trapped in localized states of the band tail or deep localized states in the band gap and to be emitted therefrom, thereby canceling the surface charge. In this case, carriers which reach the surface while passing through a charger rarely contribute to degrading the chargeability, but carriers which are trapped in deep states reach the surface after passing through the charger, thereby canceling the surface charge, so these carriers are observed as a temperature characteristic. Carriers thermally excited after passing through the charger cancel the surface charge to degrade the chargeability. Thus, for the purpose of improving the temperature characteristic and the chargeability, it is necessary to prevent thermally excited carriers from being generated and reduce deep localized states to improve the travelling of the carriers and balance thereof.

Furthermore, optical memory can be assumed to occur because light carriers generated by pre-exposure light and image exposure light are trapped in localized states of the band gap and because the carriers remain in the photoconductive layer. That is, among the light carriers generated during a copying process, the carriers remain in the photoconductive layer are swept out by electric fields generated by the surface charge during the subsequent charging or later to cause a potential difference between a portion irradiated with image exposure light and the other portions, resulting in the non-uniform density on the image. In this case, the carriers remaining in the portion irradiated with image exposure light include image exposure carriers in addition to pre-exposure carriers present even in portions that are not irradiated with image exposure light. The density of the image depends on the balance between remaining pre-exposure carriers and remaining image exposure carriers, but minimizing the remaining carriers can be assumed to be effective in improving optical memory. Thus, the travelling of the pre-exposure carriers and image exposure carriers must be improved in order to allow them to travel in a single copying process while the light carriers hardly remain in the photoconductive layer. For this purpose, the film quality of the photoconductive layer must be improved and the content and distribution of a material controlling conductivity must be varied and balanced corresponding to the pre-exposure light and image exposure light absorbing regions to improve the travelling of the carriers.

The temperature characteristic of sensitivity is obtained because in the photoconductive layer, electrons travel faster than holes with a larger difference in travelling and because their travelling varies due to the temperature. In the light incidence portion, pairs of a hole and an electron are generated but in a positively charged drum, holes travel toward the support side while electrons travel toward the surface layer side. If during this movement, holes and electrons coexist in the light incidence portion, they are likely to be recombined together before they reach the support or the surface. Since the rate of recombination varies depending on thermal excitation from the re-capturing center, image exposure, that is, the number of light carriers and the number of carriers that cancel the surface potential vary with the temperature, thereby varying the sensitivity with the temperature. Furthermore, the rate of recombination of light carriers generated in the photoconductive layer due to pre-exposure varies with the temperature to vary the number of remaining light carriers, whereby the chargeability varies and its sensitivity is affected by the temperature. Therefore, the absorption coefficient for light from a long-wave laser or LED must be increased so as to reduce the rate of recombination in the light incidence portion, that is, to reduce the deep states constituting the re-capturing center and make smaller the area where holes and electrons coexist. In addition, the content and distribution of the material controlling conductivity must be varied so as to improve and balance the travelling of electrons and holes in the light incidence portion.

Furthermore, the linearity of sensitivity is attributed to the increase of carriers (electrons) that travel over a long distance due to the increase of light carriers in a deep place relative to the surface with the increase of the image exposure of a large-wavelength laser or LED. Furthermore, it is also attributed to the variation of the rate of recombination of light carriers generated in the photoconductive layer due to pre-exposure by temperature, thereby causing the number of remaining light carriers to vary to affect the travelling of light carriers generated due to image exposure. Thus, the optical absorption rate of the light incidence portion must be improved and the content and distribution of the substance controlling conductivity must be varied to improve and balance the travelling of electrons and holes in the light incidence portion.

In addition, when the content of hydrogen in the photoconductive layer is reduced to narrow Eg, the number of thermally excited carriers becomes larger than that in a photoconductive layer of an increased Eg. However, since in this case the absorption of long-wave light can become larger and the size of the light incidence portion can be reduced, the coexistence region of holes and electrons can be miniaturized. By further reducing Eu, the rate of thermally excited carriers and light carriers trapped in localized states decreases to significantly improve the travelling of carriers. On the other hand, when the content of hydrogen is increased to enlarge Eg, the hole and electron coexistence region becomes relatively wide because the absorption coefficient of long-wave light in this case is smaller than that in the case of a narrowed Eg. When, however, Eg is increased, thermally excited carriers are prevented from being generated, and by reducing Eu, the rate of thermally excited carriers and light carriers trapped in localized states can be reduced to substantially improve the travelling of carriers.

Thus, as described above, the rate of thermally excited carriers and light carriers trapped in localized states can be reduced and at the same time the travelling of electrons and holes can be surprisingly improved by controlling and balancing the hydrogen content, Eg and Eu and by further controlling the content of the element belonging to Group IIIb of the periodic table which controls conductivity relative to silicon atoms by the absorption depth of the image exposure light and pre-exposure light incidence portions so as to obtain a total balance thereof.

In other words, the present invention employing the above constitution can simultaneously achieve at a high level, the reduction of the temperature characteristic of sensitivity, the linearity of sensitivity and the optical memory when light from a semiconductor laser and an LED is used as an exposure light source, as well as the improvement of the chargeability and the reduction of the temperature characteristic, thereby solving all the problems of the prior art described above and providing a light-receiving member exhibiting very excellent electric, optical, and photoconductive characteristics, image quality, durability, and use environment characteristics.

DETAILED DESCRIPTION OF THE PREFERRED EMBODIMENTS

An electrophotographic light-receiving member according to this invention is described below in detail with reference to the drawings.

Figure 1:
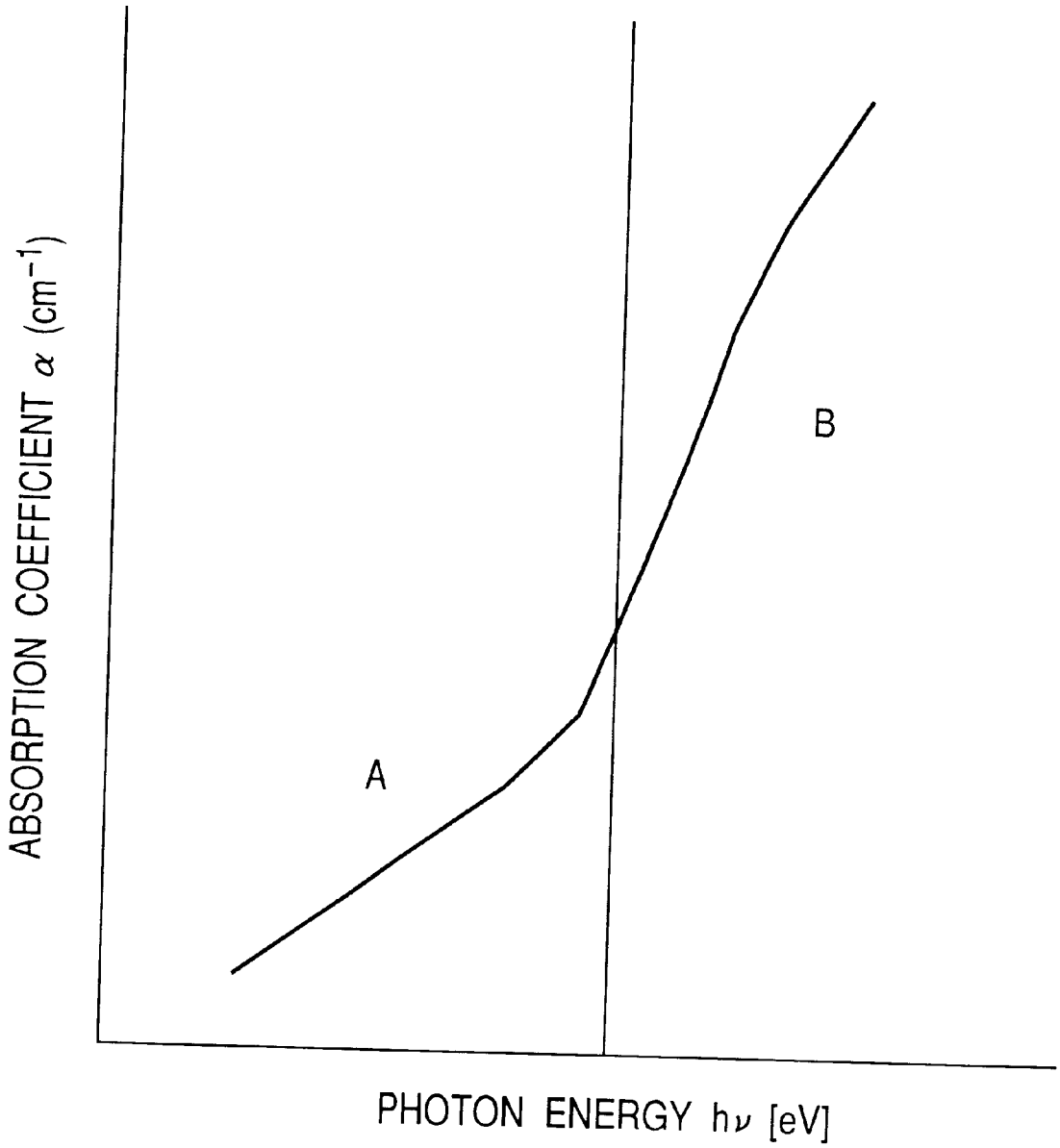
FIG. 1 is a graph of one example of a subgap optical absorption spectrum of a-Si for illustrating the characteristic energy of the Urbach tail in the present invention.
Figure 2:
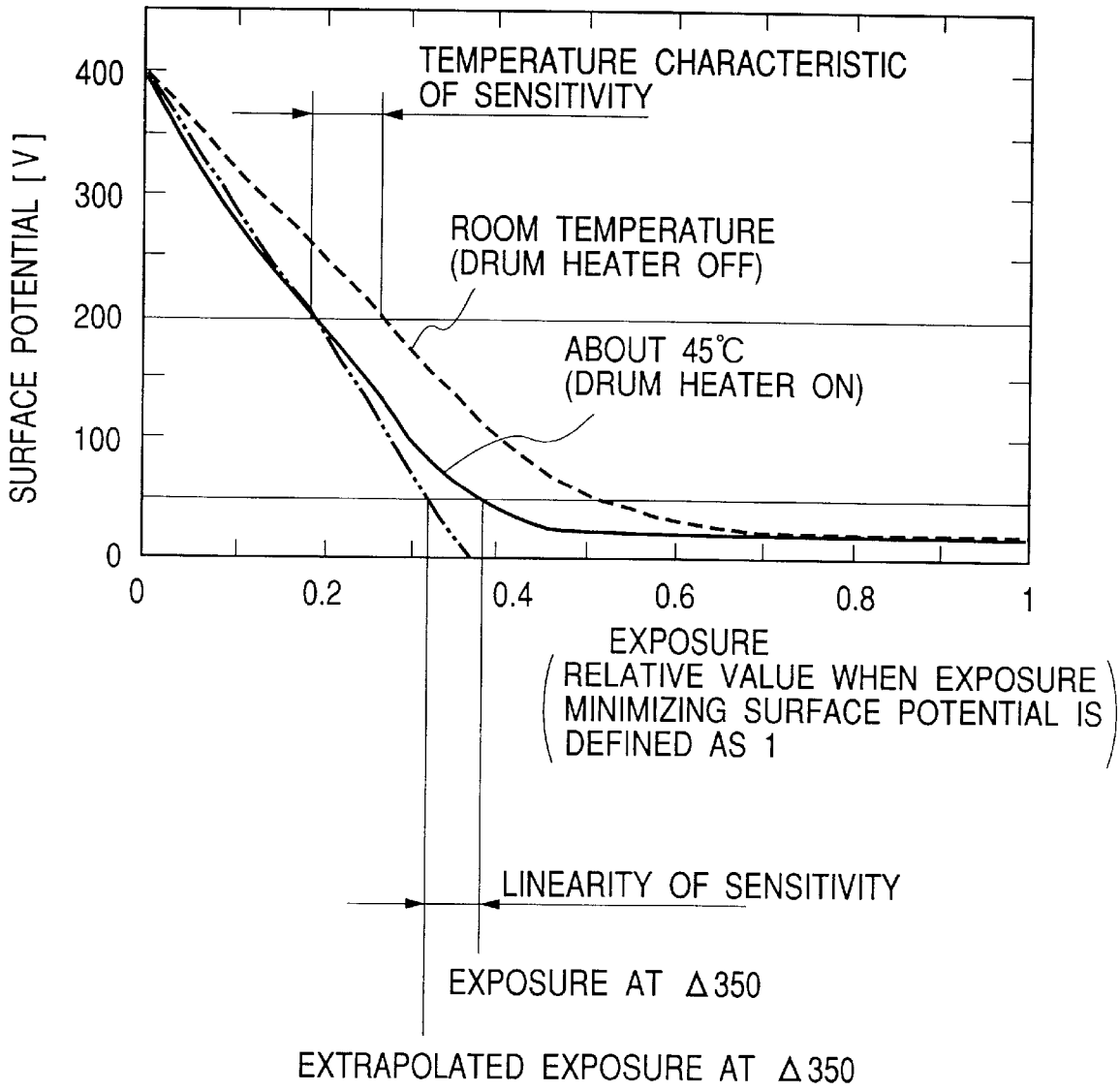
FIG. 2 is a graph of one example of the exposure-surface potential curve of an a-Si photosensitive member for illustrating the temperature characteristic and linearity of sensitivity in the present invention.
Figure 3A:
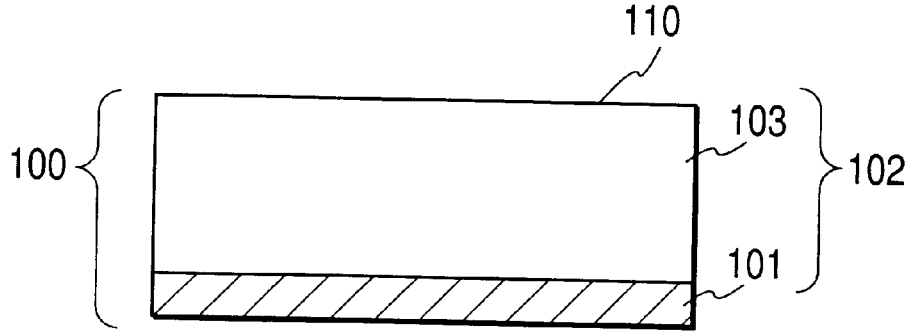
FIGS. 3A, 3B and 3C are schematically cross-sectional views for showing the layer constitution of a preferred embodiment of a light-receiving member according to the present invention.
Figure 3B:
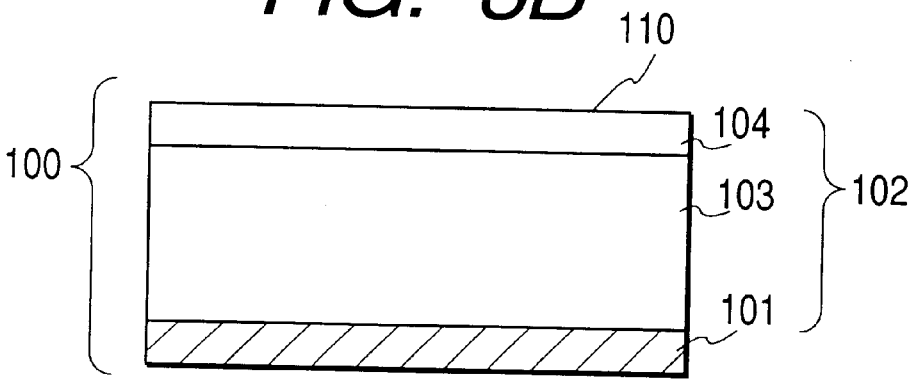
Figure 3C:
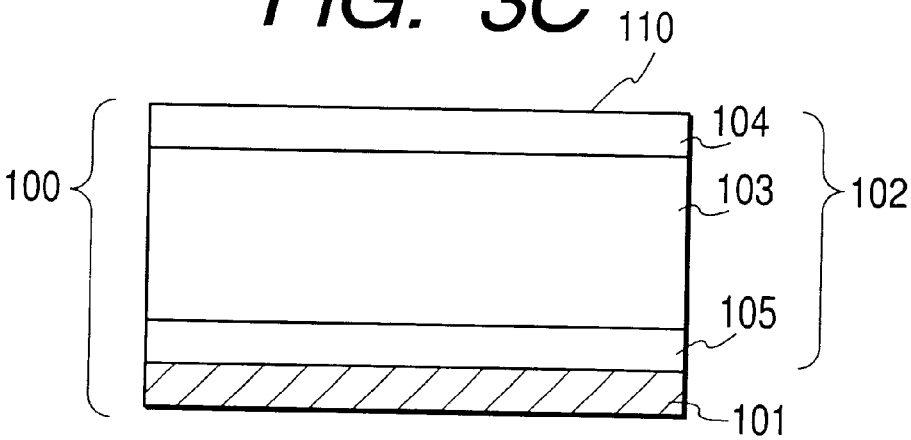

FIGS. 3A to 3C are cross-sectional views for showing examples of a preferable layer constitution of the electrophotographic light-receiving member according to this invention.

An electrophotographic light-receiving member 100. shown in FIG. 3A is formed by providing a light-receiving layer 102 on a support 101 for a light-receiving member. The light-receiving layer 102 is consisted of a photoconductive layer 103 of a non-monocrystalline semiconductor, preferably non-monocrystalline silicon, and more preferably an amorphous material containing silicon as a matrix and hydrogen and/or halogen (hereinafter referred to as "a-Si:H, X").

FIG. 3B is a cross-sectional view showing another layer constitution of an electrophotographic light-receiving member according to this invention. An electrophotographic light-receiving member 100 shown in FIG. 3B is formed by providing a light-receiving layer 102 on a support 101 for a light-receiving member. The light-receiving layer 102 is consisted of a photoconductive layer 103 of a non-monocrystalline semiconductor, preferably non-monocrystalline silicon, and more preferably an amorphous material of a-Si:H, X; and an amorphous silicon based surface layer 104.

FIG. 3C is a cross-sectional view showing an example of another layer constitution of the electrophotographic light-receiving member according to this invention. An electrophotographic light-receiving member 100 shown in FIG. 3C is formed by providing a light-receiving layer 102 on a support 101 for a light-receiving member. The light-receiving layer 102 is consisted of a photoconductive layer 103 of a non-monocrystalline semiconductor, preferably non-monocrystalline silicon, and more preferably an amorphous material of a-Si:H, X; an amorphous silicon based surface layer 104; and an amorphous silicon based charge injection inhibiting layer 105.

The non-monocrystalline semiconductor layer is not limited to an amorphous semiconductor, but a microcrystalline or a polycrystalline material or their mixture may be used as long as they can be applied to an electrophotographic light-receiving member.

Support

The support used in this invention may be electroconductive or electrically insulating. The electroconductive support includes a metal such as Al, Cr, Mo, Au, In, Nb, Te, V, Ti, Pt, Pd and Fe, and their alloy, for example, stainless steel.

In addition, the electrically insulating material includes a film or sheet of a synthetic resin such as polyester, polyethylene, polycarbonate, cellulose acetate, polypropyrene, polyvinyl chloride, polystyrene, and polyamide; glass; and ceramics. According to this invention, the support may be obtained by providing conductivity for at least one surface of an electrically insulating material on which the light-receiving layer is formed.

The shape of the support 101 used in this invention may be a cylindrical shape or an end-less belt-like shape having a smooth surface or a finely uneven surface. The thickness of the support may be determined as required so as to form a desired electrophotographic light-receiving member 100. When the electrophotographic light-receiving member 100 is required to be flexible, the thickness of the support 101 may be reduced as much as possible as long as its supporting function can be provided appropriately. The support 101, however, should normally have a thickness of 10 $\mu$m or more so as to be convenient in manufacturing and handling and to provide a sufficient mechanical strength.

In particular, when coherent light such as laser light is used to record images, uneven portions may be provided on the surface of the support 101 to more effectively prevent image defects due to interference fringe. The uneven portions provided on the surface of the support 101 are formed by the known methods described in Japanese Patent Application Laid-Open Nos. 60-168156, 60-178457 and 60-225854.

As another method for more effectively preventing image defects due to interference fringe when coherent light such as laser light is used, uneven portions may be provided on the surface of the support 101 utilizing spherical trace dents. In other words, the surface of the support 101 has fine recessed and protruding portions which provide a higher resolution than that required for the electrophotographic light-receiving member 100, and these recessed and protruding portions are formed of the plurality of spherical trace dents. The recessed and protruding portions formed of plurality of spherical trace dents provided on the surface of the support 101 are formed by the known method described in Japanese Patent Application Laid-Open No. 61-231561.

Photoconductive Layer

To effectively achieve the objects of this invention, the photoconductive layer 103 formed on the support 101 and constituting at least a part of the light-receiving layer 102 is produced using, for example, a vacuum deposition film formation method by setting numerical conditions for film formation parameters and selecting a source gas in order to obtain desired characteristics. Specifically, various film deposition methods may be used including, for example, the glow discharge method (the AC discharge CVD method such as the low-frequency CVD method, high-frequency CVD method or microwave CVD method, or the DC discharge CVD method or the like), the sputtering method, the vacuum evaporation method, the ion plating method, the light CVD method, and the heat CVD method.

The film deposition method is suitably selected depending on factors such as manufacturing conditions, loads resulting from plant and equipment investment, manufacturing scale, and characteristics desired for the formed electrophotographic light-receiving member. In manufacturing an electrophotographic light-receiving member having desired characteristics, however, the high-frequency glow discharge method is preferred because it allows the conditions to be controlled relatively easily.

In formation of the photoconductive layer using the glow discharge method, a source gas capable of supplying silicon (Si) atoms and a source gas capable of supplying hydrogen (H) and/or halogen (X) atoms may be introduced into a reaction container the internal pressure of which can be reduced while the gases maintain a desired gas state, and then glow discharge may be caused in the reaction container to form a layer consisting of a-Si:H, X on the predetermined support 101 installed at a predetermined position.

In addition, this invention requires hydrogen and/or halogen atoms to be contained in the photoconductive layer 103 in order to compensate for the dangling bonds of silicon atoms in the layer. This is essential in improvement of layer quality, in particular, photoconductivity and charge retainability. The content of hydrogen or halogen atoms or the sum of the contents of hydrogen and halogen atoms is preferably 10 to 45 atomic %, more preferably 10 to 40 atomic % relative to the sum of the contents of silicon atoms and hydrogen and/or halogen atoms.

The substance that can be effectively used as the Si-supplying gas used in this invention includes silicon hydride (silane) such as $SiH_4$, $Si_2H_6$, $Si_3H_8$, or $Si_4H_{10}$ that is in a gas state or that can be gasified. $SiH_4$ and $Si_2H_6$ are preferred in the points of their easy handling in film formation and their high Si-supplying efficiency.

For the purpose of structurally introducing the hydrogen atoms into the photoconductive layer to allow the introducing rate of hydrogen atoms to be controlled more easily and obtaining film characteristics that serve to achieve the objects of this invention, it is necessary to form a layer in an atmosphere in which these gases are mixed with a desired amount of $H_2$ and/or He or a silicon compound gas containing hydrogen atoms. Each gas is not limited to a single kind of gas, but may be a mixture of a plurality of kinds of gases in a predetermined mixing ratio.

In addition, the effective source gas used in this invention to supply halogen atoms includes, for example, a halogen gas, a halide, an interhalogen compound containing halogen, and a halogen compound that is gaseous or that can be gasified, such as a silane derivative substituted by halogen. It also includes a silicon hydride compound composed of silicon and halogen atoms which is gaseous or can be gasified. The halogen compound preferred for this invention includes fluorine gas ($F_2$) and an interhalogen compound such as BrF, ClF, $ClF_3$, $BrF_3$, $BrF_5$, $IF_3$, or $IF_7$. As the silicon compound containing halogen atoms, that is, the silane derivative substituted by halogen atoms, for example, silicon fluoride such as $SiF_4$ or $Si_2F_6$ is preferred.

The control of the amount of hydrogen and/or halogen atoms contained in the photoconductive layer 103 may be conducted, for example, by controlling the temperature of the support 101, the amount of starting substances introduced into a reaction container to supply hydrogen and/or halogen atoms, or the discharge power.

In this invention, it is necessary to contain atoms capable of controlling conductivity as required in the photoconductive layer 103. These atoms are essential in adjusting or compensating for the travelling of carriers affected by the physical properties of the photoconductive layer such as Eg and Eu to balance the travelling at a high level in order to improve the chargeability, temperature characteristic, and optical memory characteristic, as well as the temperature characteristic and linearity of sensitivity. Thus, to obtain the effects of the invention, the content of an element belonging to Group IIIb of the periodic table preferably decreases in the order of a first, a second, and a third layer regions, and the third layer region of the photoconductive layer preferably absorbs 50% to 90% of image exposure light. In addition, the content of the element belonging to group IIIb of the periodic table in this layer region is desirably 0.03 ppm to 5 ppm relative to silicon atoms. The second layer region preferably is a layer region absorbing 60% to 90% of pre-exposure light other than the third layer region, and the content of the element belonging to Group IIIb of the periodic table in this layer region is desirably 0.2 ppm to 10 ppm relative to silicon atoms. The ratio of the content of the element belonging to Group IIIb of the periodic table in the second layer region to the content of the same element in the third layer region is preferably 1.2 to 200. The content of the element belonging to group IIIb of the periodic table in the first layer region is desirably 1 ppm to 25 ppm relative to silicon atoms. If any of these contents is not within the above range, sufficient effects may not be obtained in the improvement of the chargeability, residual potential, temperature characteristic, ghost prevention, and the temperature characteristic and linearity of sensitivity.

The content of the element belonging to Group IIIb of the periodic table may vary stepwise (for example, stepwise decrease toward the surface) or smoothly (for example, smoothly decrease toward the surface).

The element controlling conductivity includes impurities in the field of semiconductors and atoms belonging to Group IIIb of the periodic table that provide a p-type conductive characteristic (hereinafter referred to as "Group IIIb atoms") can be used.

Specifically, the Group IIIb atoms include boron (B), aluminum (Al), garium (Ga), indium (In), and thallium (Tl), and particularly, B, Al, and Ga are preferable.

To structurally introduce the atoms controlling conductivity, that is, the Group IIIb atoms, a starting substance used to introduce these atoms may be introduced, during film formation, into a reaction container in a gas state together with other gases required to form the photoconductive layer 103. The starting substance used to introduce the Group IIIb atoms is desirably gaseous at the room temperature and the atmospheric pressure or can at least be gasified easily under layer formation conditions.

Specifically, the starting substance used to introduce the Group IIIb atoms includes boron hydride such as $B_2H_6$, $B_4H_{10}$, $B_5H_9$, $B_5H_{11}$, $B_6H_{10}$, $B_6H_{12}$, and $B_6H_{14}$, and boron halide such as $BF_3$, $BCl_3$, and $BBr_3$. Such a starting substance may include $AlCl_3$, $GaCl_3$ $Ga(CH_3)_3$, $InCl_3$, and $TlCl_3$. $B_2H_6$ is one of the preferred starting substances in the point of its easy handling.

In addition, the starting substance used to introduce the atoms controlling conductivity may be diluted with $H_2$ and/or He as required.

Furthermore, according to this invention, the photoconductive layer 103 effectively contains at least one kind selected from a group consisting of carbon, oxygen, and nitrogen atoms. The content of carbon, oxygen or nitrogen atoms is preferably $1\times10^{-4}$ to 10 atomic %, more preferably $1\times10^{-4}$ to 8 atomic %, most preferably $1\times10^{-3}$ to 5 atomic % relative to the sum of the contents of silicon, carbon, oxygen and nitrogen atoms. The carbon, oxygen, or nitrogen atoms may be uniformly contained throughout the photoconductive layer or may be non-uniformly distributed in such a way that the content varies in the thickness direction of the photoconductive layer.

According to this invention, the thickness of the photoconductive layer 103 is determined as required for desired electrophotographic characteristics and economic effects and is preferably 20 to 50 $\mu$m, more preferably 23 to 45 $\mu$m, much more preferably 25 to 40 $\mu$m. If the thickness is less than 20 $\mu$m, then the electrophotographic characteristics such as the chargeability and sensitivity may be practically insufficient. If the thickness exceeds 50 $\mu$m, then the time required to produce the photoconductive layer increases and also manufacturing costs increase.

To achieve the objects of this invention and to form the photoconductive layer 103 having desired film characteristics, it is necessary to suitably set the mixture ratio of the Si-supplying gas to a dilution gas, the pressure of the gas in the reaction container, the discharge power, and the temperature.

The optimal range of the flow rate of $H_2$ and/or He used as the dilution gas is suitably selected as required for a layer design, but the flow rate of $H_2$ and/or He is normally controlled to be 3 to 30 times, preferably 4 to 25 times, most preferably 5 to 20 times as large as that of the Si-supplying gas. In addition, the flow rate is preferably controlled to be constant within these ranges.

The optimal range of the pressure of the gas in the reaction container is also suitably selected as required for the layer design, but is normally $1\times10^{-2}$ to $2\times10^{3}$ Pa, preferably $5\times10^{-2}$ to $5\times10^{2}$ Pa, most preferably $1\times10^{-1}$ to $2\times10^{2}$ Pa.

The optimal range of the discharge power is also suitably selected as required for the layer design, but the ratio of the discharge power to the flow rate of the Si-supplying gas is set at 0.3 to 10, preferably 0.5 to 9, more preferably 1 to 6.

Furthermore, the optimal range of the temperature of the support 101 is suitably selected as required for the layer design, but is preferably 200 to 350° C., more preferably 230 to 330° C., much more preferably 250 to 310° C.

According to this invention, although the numerical ranges of the support temperature and gas pressure that are desired to form the photoconductive layer are as described above, these conditions are normally not determined independently but the optimal values are desirably determined based on the interrelations among the conditions so as to form a light-receiving member having desired characteristics.

Surface Layer

According to this invention, the surface layer 104 comprising non-monocrystal, for example, amorphous silicon is preferably formed on the photoconductive layer 103 formed on the support 101 as described above. The surface layer 104 has a free surface 106 and is provided to achieve the objects of this invention mainly in terms of humid resistance, repeated-use characteristic, voltage resistance, use environment characteristic, and durability.

In addition, according to this invention, the photoconductive layer 103 constituting the light-receiving layer 102 and the amorphous material forming the surface layer 104 each have silicon atoms as a common component, and therefore chemical stability is provided in the interfaces between deposited layers.

The surface layer 104 may comprise any non-monocrystalline material, for example, an amorphous silicon material, but preferred materials include, for example, amorphous silicon containing hydrogen (H) and/or halogen (X) atoms and carbon atoms (hereinafter referred to as "a-SiC:H, X"), amorphous silicon containing hydrogen (H) and/or halogen (X) atoms and oxygen atoms (hereinafter referred to as "a-SiO:H, X"), amorphous silicon containing hydrogen (H) and/or halogen (X) atoms and nitrogen atoms (hereinafter referred to as "a-SiN:H, X"), and amorphous silicon containing hydrogen (H) and/or halogen (X) atoms and at least one kind of carbon, oxygen, and nitrogen atoms (hereinafter referred to as "a-SiCON:H, X").

To achieve the objects of this invention, the surface layer 104 is produced by using a vacuum deposition film formation method and setting numerical conditions for film formation parameters as required for desired characteristics. Specifically, various thin film deposition methods may be used including, for example, the glow discharge method (the AC discharge CVD method such as the low-frequency CVD method, high-frequency CVD method or microwave CVD method, or the DC discharge CVD method or the like), the sputtering method, the vacuum evaporation method, the ion plating method, the light CVD method, and the heat CVD method. The thin film deposition method is suitably selected as required depending on factors such as manufacturing conditions, loads resulting from plant and equipment investment, manufacturing scale, and characteristics desired for the formed electrophotographic light-receiving member. A deposition method similar to that used for the photoconductive layer is preferably used for the productivity of the light-receiving member.

For example, in formation of the surface layer 104 consisting of a-SiC:H, X by using the glow discharge method, a source gas capable of supplying silicon atoms (Si) and a source gas capable of supplying hydrogen (H) and/or halogen (X) atoms are basically introduced into a reaction container the internal pressure of which can be reduced while the gases maintain a desired gas state and then glow discharge is caused in the reaction container to form a layer consisting of a-SiC:H, X on the photoconductive layer 103 formed on the predetermined support 101 at a predetermined position.

The material of the surface layer used in this invention may be any amorphous material containing silicon, but is preferably a compound containing silicon atoms and at least one element selected from carbon, nitrogen and oxygen, more preferably a compound comprising a-SiC as a main component.

The content of carbon required to form the surface layer comprising a-SiC as a main component is preferably in a range of 30 and 90% relative to the sum of the contents of silicon and carbon atoms.

In addition, this invention requires hydrogen and/or halogen atoms to be contained in the surface layer 104 in order to compensate for the dangling bonds of component atoms such as silicon atoms and in order to improve layer quality, in particular, photoconductivity and charge retainability. The content of hydrogen atoms is preferably 30 to 70 atomic %, more preferably 35 to 65 atomic %, much more preferably 40 to 60 atomic t relative to the sum of the contents of component atoms. In addition, the content of fluorine atoms is normally 0.01 to 15 atomic %, preferably 0.1 to 10 atomic %, most preferably 0.6 to 4 atomic %.

The light-receiving member formed using the above range of the content of hydrogen and/or fluorine is much more excellent than that of the prior art and can thus be put to practical use. Defects (mainly dangling bonds of silicon or carbon atoms) present in the surface layer are known to adversely affect the characteristics of the electrophotographic light-receiving member. For example, charges may be injected from the free surface to degrade the charging characteristic, the surface structure may be changed due to the use environment, for example, a high humidity to vary the charging characteristic, or charges may be injected to the surface layer through the photoconductive layer during corona charging or light radiation and may be trapped in the defects in the surface layer, resulting in afterimages during repeated use.

However, by controlling the content of hydrogen in the surface layer to 30 atomic % or more, the defects in the surface can be significantly reduced to substantially improve electric characteristics and high speed continuous usability.

On the other hand, when the content of hydrogen in the surface layer is 71 atomic % or more, the hardness of the surface layer may decrease and in some cases the member does not withstand repeated use. Thus, the control of the hydrogen content within the above range is a very important factor in providing noticeably excellent desired electrophotographic characteristics. The content of hydrogen in the surface layer can be controlled by the flow rate of the source gas (ratio of flow rate), the temperature of the support, the discharge power, the gas pressure and the like.

In addition, by controlling the content of fluorine in the surface layer to 0.01 atomic % or more, silicon and carbon atoms in the surface layer can be more effectively bonded. Furthermore, fluorine atoms in the surface layer can prevent cutting of bonds between silicon and carbon atoms due to damage caused by corona and like.

On the other hand, when the content of fluorine in the surface layer exceeds 15 atomic %, few effects of bonding silicon and carbon atoms together and preventing cutting of bonds between silicon and carbon atoms due to damage caused by corona and the like are obtained. Moreover, since an excessive amount of fluorine atoms hinder carriers in the surface layer from travelling, a notable residual potential or image memory may occur. Thus, the control of the fluorine content of the surface layer within the above range is a very important factor in obtaining desired electrophotographic characteristics. Like the content of hydrogen, the content of fluorine in the surface layer can be controlled by the flow rate of the source gas (ratio), the temperature of the support, the discharge power, the gas pressure and the like.

The substance that can be effectively used as the silicon (Si)-supplying gas used to form the surface layer according to this invention includes silicon hydride (silane) such as $SiH_4$, $Si_2H_6$, $Si_3H_8$, or $Si_4H_{10}$ that is in a gas state or that can be gasified. $SiH_4$ and $Si_2H_6$ are preferred in the points of easy handling in film formation and high Si-supplying efficiency. In addition, these Si-supplying source gas may be diluted with a gas such as $H_2$, He, Ar, or Ne as required.

The substance that can be effectively used to provide the carbon-supplying gas includes hydrocarbon such as $CH_4$, $C_2H_2$, $C_2H_6$, $C_3H_8$ or $C_4H_{10}$ that is in a gas state or that can be gasified. $CH_4$, $C_2H_2$ and $C_2H_6$ are preferred in the points of easy handling in film formation and high C-supplying efficiency. In addition, these C-supplying source gases may be diluted with a gas such as $H_2$, He, Ar or Ne as required.

The substance that can effectively be used to provide the nitrogen- or oxygen-supplying gas includes compounds such as $NH_3$, NO, $N_2O$, $NO_2$, $O_2$, CO, $CO_2$ or $N_2$ that are in a gas state or that can be gasified. In addition, these nitrogen- or oxygen-supplying source gas may be diluted with a gas such as $H_2$, He, Ar, or Ne as required.

To facilitate the control of the rate of hydrogen atoms introduced into the surface layer 104, a desired amount of hydrogen gas or a silicon compound gas containing hydrogen atoms is preferably mixed with the above gases to form the layer. In addition, each gas is not limited to one kind but a plurality of kinds of gases may be mixed at a predetermined mixture ratio.

The effective source gas for supplying halogen atoms preferably includes, for example, a halogen gas, a halide, an interhalogen compound containing halogen, and a halogen compound that is gaseous or that can be gasified, for example, a silane derivative substituted by halogen. It also includes a silicon hydride compound that is composed of silicon and halogen atoms and that is gaseous or that can be gasified.

The halogen compound suitably used for this invention includes fluorine gas ($F_2$) and an interhalogen compound such as BrF, ClF, $ClF_3$, $BrF_3$, $BrF_5$, $IF_3$ and $IF_7$. As silicon compound containing halogen atoms, that is, the silane derivative substituted by halogen atoms, for example, silicon fluoride such as $SiF_4$ or $Si_2F_6$ is preferred.

To control the amount of hydrogen and/or halogen atoms contained in the surface layer 104, for example, the temperature of the support 101, the amount of material substances for supplying hydrogen and/or halogen atoms which are introduced into a reaction container, or the discharge power may be controlled.

The carbon, oxygen, or nitrogen atoms may be uniformly contained throughout the surface layer or may be non-uniformly distributed in such a way that the content varies in the thickness direction of the surface layer.

Furthermore, in this invention, atoms for controlling conductivity are preferably contained in the surface layer 104, if necessary. The atoms for controlling conductivity may be contained in the surface layer 104 in such a way as to be uniformly distributed throughout the layer 104 or to be partly non-uniformly distributed in the thickness direction of the layer.

The atom for controlling said conductivity includes impurities in the field of semiconductors and atoms belonging to Group IIIb of the periodic table that provides a p-type conductive characteristic (hereinafter referred to as "Group IIIb atoms") or atoms belonging to Group Vb of the periodic table that provides an n-type conductive characteristic (hereinafter referred to as "Group Vb atoms") can be used.

Specifically, the Group IIIb atoms include boron (B), aluminum (Al), garium (Ga), indium (In), and thallium (Tl), and particularly B, Al and Ga are preferable. The Group Vb atoms include phosphorous (P), arsenic (As), antimony (Sb) and bismuth (Bi). Particularly, P and As are preferable.

The content of atoms for controlling conductivity that are contained in the surface layer 104 is preferably $1\times10^{-3}$ to $1\times10^{3}$ atomic ppm, more preferably $1\times10^{-2}$ to $5\times10^{2}$ atomic ppm, most preferably $1\times10^{-1}$ to $1\times10^{2}$ atomic ppm.

To structurally introduce the atoms for controlling conductivity, for example, the Group IIIb atoms or the Group Vb atoms, a starting substance for introducing the Group IIIb atoms or Group Vb atoms in a gas state may be introduced into a reaction container together with other gases for forming the surface layer 104, during film formation. The starting substance for introducing the Group IIIb atoms or the Group Vb atoms is desirably gaseous at the room temperature and the atmospheric pressure or can at least be gasified easily under layer formation conditions. As the starting substance for introducing the Group IIIb atoms, specifically the starting substance for introducing boron atoms includes boron hydride such as $B_2H_6$, $B_4H_{10}$, $B_5H_9$, $B_5H_{11}$, $B_6H_{10}$, $B_6H_{12}$ and $B_6H_{14}$ and boron halide such as $BF_3$, $BCl_3$, and $BBr_3$. Such a starting substance may include $AlCl_3$, $GaCl_3$, $Ga(CH_3)_3$, $InCl_3$ and $TlCl_3$.

As the starting substance that can be effectively used for introducing the Group Vb atoms, the starting substance for introducing phosphorous includes phosphorous hydride such as $PH_3$ and $P_2H_4$, and phosphorous halide such as $PH_4I$, $PF_3$, $PF_5$, $PCl_3$, $PCl_5$, $PBr_3$, $PBr_5$ and $PI_3$. The effective starting substance for introducing the Group Vb atoms may also include $AsH_3$, $ASF_3$, $AsCl_3$, $AsBr_3$, $AsF_5$, $SbH_3$, $SbF_3$, $SbF_5$, $SbCl_3$, $SbCl_5$, $BiH_3$, $BiCl_3$ and $BiBr_3$.

In addition, the starting substance for introducing the atoms for controlling conductivity may be diluted with $H_2$, He, Ar or Ne gases as required.

The thickness of the surface layer 104 according to this invention is preferably 0.01 to 3 $\mu$m, more preferably, 0.05 to 2 $\mu$m, much more preferably 0.1 to 1 $\mu$m. When the thickness is smaller than 0.01 $\mu$m, the surface layer may be lost due to wear during the use of the light-receiving member. When the thickness exceeds 3 $\mu$m, the degradation of the electrophotographic characteristics such as the increase of residual potential occurs in some cases.

The surface layer 104 according to this invention is carefully formed so as to provided desired characteristics as required. In other words, depending on forming conditions, the substance composed of Si; at least one element selected from a group consisting of C, N and O; and H and/or X becomes a form ranging from a crystal such as a polycrystal or microcrystal to an amorphous structure (collectively called "non-monocrystal") and exhibits an electric property ranging from conductivity through semiconductivity to insulation and photoconductivity or non-photoconductivity. Thus, this invention strictly selects the forming conditions as required to form a compound having desired characteristics that meet the purpose.

For example, when the surface layer 104 is provided mainly for the purpose of improving voltage resistance, it is produced as a non-monocrystalline material exhibiting notable electric-insulating behavior in the use environment.

In addition, when the surface layer 104 is provided mainly for the purpose of improving the continuously repeating use and use environment characteristics, the level of electric insulation is reduced to some degree and the surface layer is formed as a non-monocrystalline material having a certain level of sensitivity to radiated light.

To form the surface layer 104 having characteristics that meet the objects of this invention, the temperature of the support 101 and the pressure of the gas in the reaction container must be suitably set as required.

The optimal range of the temperature (Ts) of the support 101 is suitably selected as required for the layer design, and is in a normal case preferably 200 to 350° C., more preferably 230 to 330° C., most preferably 250 to 310° C.

The optimal range of the pressure of the gas in the reaction container is also suitably selected as required for the layer design, but is in a normal case preferably $1\times10^{-2}$ to $2\times10^{3}$ Pa, more preferably $5\times10^{-2}$ to $5\times10^{2}$ Pa, most preferably $1\times10^{-1}$ to $2\times10^{2}$ Pa.

In this invention, although the numerical ranges of the support temperature and gas pressure for forming the surface layer are as described above, these conditions are normally not determined independently but the optimal values are desirably determined based on the interrelations between the conditions so as to form a light-receiving member having desired characteristics.

Furthermore, in to this invention, providing between the photoconductive layer and the surface layer a blocking layer (a lower surface layer) having smaller contents of carbon, oxygen and nitrogen atoms than the surface layer is effective in further improvement of characteristics such as the chargeability.

In addition, a region in which the contents of carbon and/or oxygen and/or nitrogen atoms decrease toward the photoconductive layer 103 may be provided between the surface layer 104 and the photoconductive layer 103. This region serves to improve the adhesion between the surface layer and the photoconductive layer to reduce the effect of interference caused by the reflection of light in the interface.

Charge Injection Inhibiting Layer

In the electrophotographic light-receiving member according to this invention, it is more effective to provide between the electroconductive support and the photoconductive layer a charge injection inhibiting layer that serves to inhibit the injection of charges from the conductive support side. In other words, the charge injection inhibiting layer has a function of inhibiting the injection of charges from the support into the photoconductive layer when the free surface of the light-receiving layer receives is subjected to a charging treatment of a specified polarity. But it does not have the above function when the free surface of the light-receiving layer is subjected to a charging treatment of the opposite polarity. That is, the charge injection inhibition layer depends on the polarity. To provide such a function for this layer, a larger amount of atoms for controlling conductivity are contained in the charge injection inhibiting layer than that in the photoconductive layer. The charge injection inhibiting layer is preferably formed of a non-monocrystalline material.

The atoms to be contained in the layers for controlling conductivity may be uniformly distributed throughout the layer or may be uniformly contained in the thickness direction throughout the layer while a non-uniform distribution portion is present. When the distribution concentration is not uniform, such atoms are preferably distributed so that its content is larger on the support side.

In either case, however, it is necessary to uniformly distribute the atoms in the direction of a plane parallel with the surface of the support throughout the plane in order to make the characteristics uniform in the plane direction. The atoms to be contained in the charge injection inhibiting layer for controlling conductivity include impurities in the field of semiconductors, and atoms belonging to Group IIIb of the periodic table that provides a p-type conductive characteristic (hereinafter referred to as "Group IIIb atoms") may be used.

Specifically, the Group IIIb atoms include boron (B), aluminum (Al), garium (Ga), indium (In) and thallium (Ta), and particularly, B, Al and Ga are preferable.

The content of atoms contained in the charge injection inhibiting layer to control conductivity in this invention is determined as required to effectively achieve the objects of this invention, but is preferably 10 to $1\times10^{4}$ atomic ppm, more preferably 50 to $5\times10^{3}$ atomic ppm, much more preferably $1\times10^{2}$ to $3\times10^{3}$ atomic ppm.

Furthermore, at least one kind of carbon, nitrogen and oxygen atoms can be contained in the charge injection inhibiting layer to further improve the adhesion between the charge injection inhibiting layer and another layer provided in direct contact with the charge injection inhibiting layer.

The carbon, nitrogen or oxygen in the layer may be uniformly distributed throughout the layer or may be uniformly contained in the thickness direction throughout the layer while a non-uniform distribution portion is present. In either case, however, it is necessary to uniformly distribute the atoms in the direction of a plane parallel with the surface of the support throughout the plane in order to make the characteristics uniform in the plane direction.

The content of carbon, nitrogen or oxygen atoms contained in all layer regions of the charge injection inhibiting layer is determined as required to effectively achieve the objects of this invention, but the content of one kind of atoms or the sum of two or more kinds of atoms is preferably $1\times10^{-3}$ to 50 atomic %, more preferably $5\times10^{-3}$ to 30 atomic %, much more preferably $1\times10^{-2}$ to 10 atomic %.

In addition, the hydrogen and/or halogen atoms contained in the charge injection inhibiting layer according to this invention compensates for dangling bonds present in the layer to improve the film quality. The content of hydrogen or halogen atoms or the sum of the contents of hydrogen and halogen atoms is preferably 1 to 50 atomic %, more preferably 5 to 40 atomic %, much more preferably 10 to 30 atomic %.

To obtain desired electrophotographic characteristics and economic effects, the thickness of the charge injection inhibiting layer is preferably 0.1 to 5 $\mu$m, more preferably 0.3 to 4 $\mu$m, much more preferably 0.5 to 3 $\mu$m. When the thickness is smaller than 0.1 $\mu$m, the capability of inhibiting charges injected from the support will be insufficient and thus the chargeability will be also insufficient. When the thickness exceeds 5 $\mu$m, production time increases and therefore manufacturing costs increase rather than the substantial improvement of the electrophotographic characteristics.

To form the charge injection inhibiting layer in this invention, the vacuum deposition method is used similarly as in the formation of the photoconductive layer.

To form the charge injection inhibiting layer 105 having characteristics that meet the objects of this invention, the mixing ratio of the Si-supplying gas and the dilution gas, the pressure of the gas in the reaction container, the discharge power, and the temperature of the support 101 must be suitably set similarly to the formation of the photoconductive layer 103.

The optimal range of the flow rate of $H_2$ and/or He that are dilution gas is suitably selected as required for the layer design, but the flow rate of $H_2$ and/or He is preferably controlled to be 1 to 20 times, more preferably 3 to 15 times, much more preferably 5 to 10 times as large as that of the Si-supplying gas.

The optimal range of the pressure of the gas in the reaction container is also suitably selected as required for the layer design, but is in a normal case $1\times10^{-2}$ to $2\times10^{3}$ Pa, preferably $5\times10^{-2}$ to $5\times10^{2}$ Pa, most preferably $1\times10^{-1}$ to $2\times10^{2}$ Pa.

The optimal range of the discharge power is also suitably selected as required for the layer design, but the ratio of the discharge power to the flow rate of the Si-supplying gas is preferably set in a range of 1 to 7, more preferably 2 to 6, much more preferably 3 to 5.

Furthermore, the optimal range of the temperature of the support 101 is suitably selected as required for the layer design, but is preferably 200 to 350° C., more preferably 230 to 330° C., much more preferably 250 to 310° C.

In this invention, although the numerical ranges of the mixing ratio of the dilution gas, the gas pressure, discharge power and the temperature of the support for forming the charge injection inhibiting layer are as described above, these film forming factors are normally not determined independently but the optimal values of the film forming factors are desirably determined based on the interrelations between the factors so as to form a surface layer having desired characteristics.

In addition, in the electrophotographic light-receiving member according to this invention, the light-receiving layer 102 desirably has on the side of the support 101 a layer region containing at least aluminum, silicon, hydrogen and/or halogen atoms distributed non-uniformly in the direction of the thickness.

In addition, in the electrophotographic light-receiving member according to this invention, an adhesion layer composed of, for example, $Si_3N_4$, $SiO_2$, SiO or an amorphous material containing silicon atoms as a matrix and hydrogen and/or halogen atoms, and carbon and/or oxygen and/or nitrogen atoms may be provided to further improve the adhesion between the support 101 and the photoconductive layer 103 or charge injection inhibiting layer 105. Furthermore, a light absorbing layer may be provided that prevents generation of interference fringes by reflected light from the support.

Next, an apparatus for forming the light-receiving layer and a film forming method therefor are described in detail.

Figure 4:
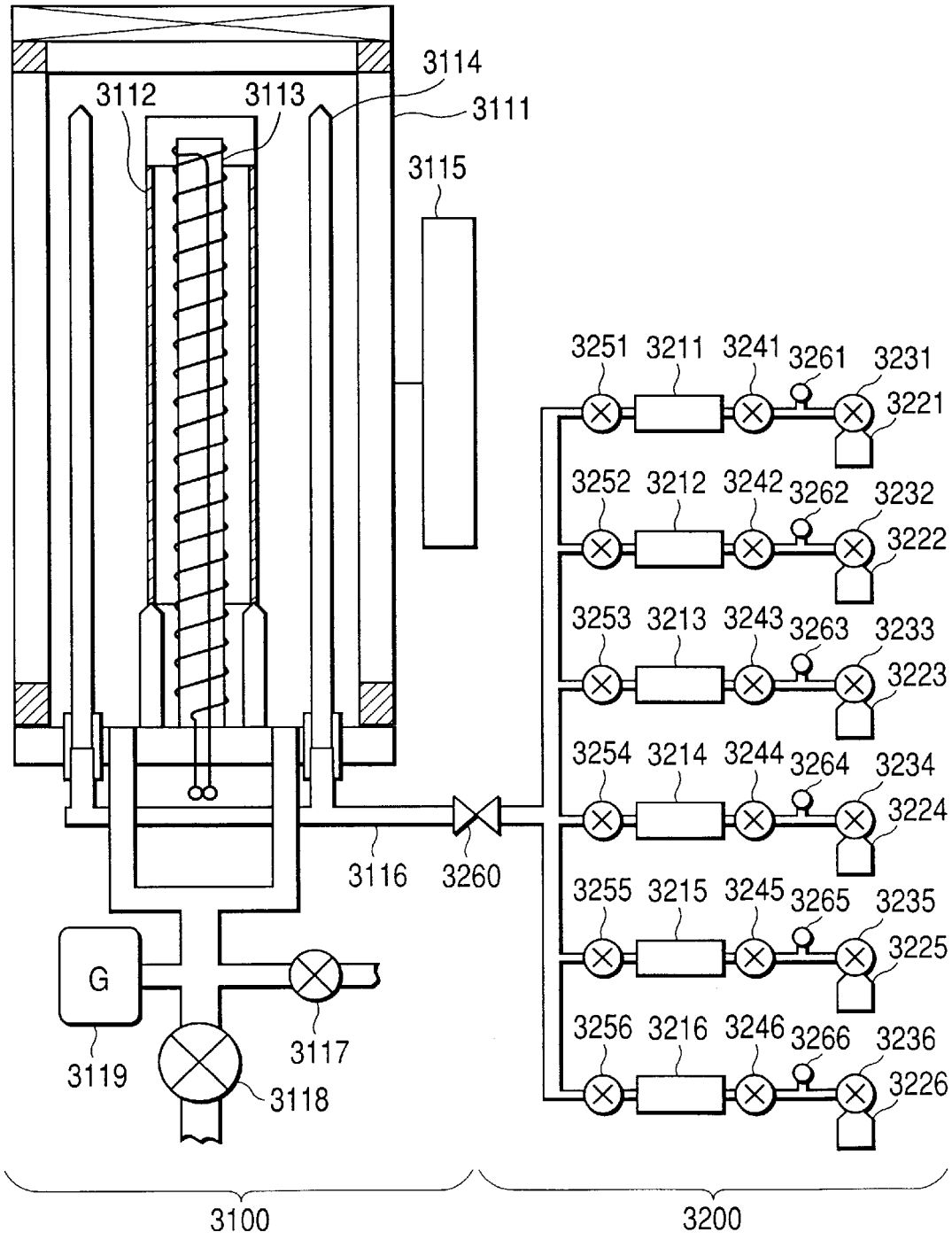
FIG. 4 is a schematic explanatory view of one example of an apparatus for producing a light-receiving member by utilizing the glow discharge method using a power supply of a high frequency in an RF band, which is an example of an apparatus for forming a light-receiving layer in a light-receiving member according to the present invention.
Figure 5A:
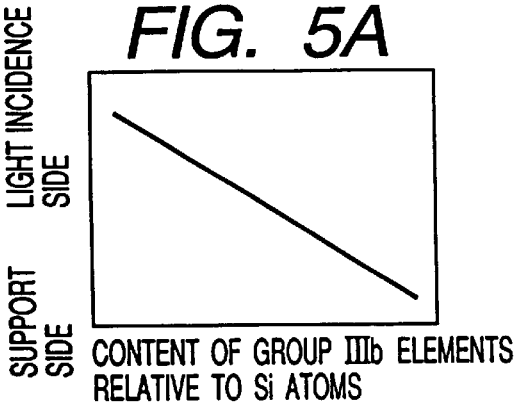
FIGS. 5A, 5B, 5C, 5D and 5E are schematic distribution graphs showing examples of the distribution of an element belonging to Group IIIb of the periodic table which is contained in a photoconductive layer region in the light-receiving member according to the present invention.
Figure 5B:
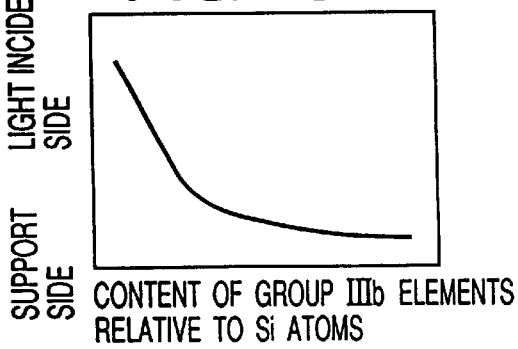
Figure 5C:
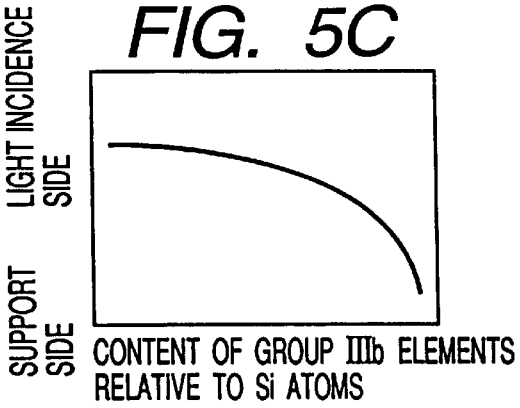
Figure 5D:
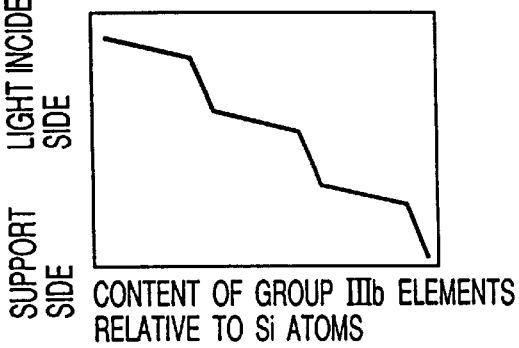
Figure 5E:
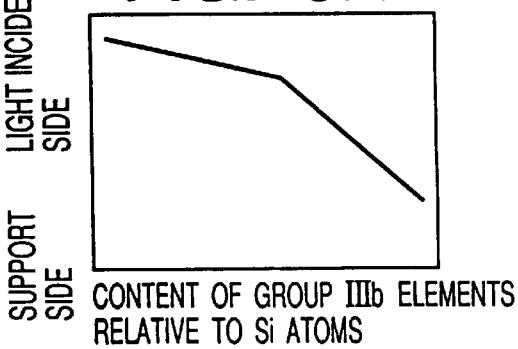

FIG. 4 is a schematically structural view for showing an example of a light-receiving member manufacturing apparatus utilizing the high-frequency plasma CVD (hereinafter referred to as "RF-PCVD") that uses an RF band as a power frequency. The constitution of the manufacturing apparatus shown in FIG. 4 is described below.

This apparatus is roughly composed of a deposition device (3100); a source gas supply device (3200); and an exhaust device (not shown in the drawings) for reducing the internal pressure of a reaction container (3111). A cylindrical support (3112), a heater (3113) for heating the support, and a source gas introduction pipe (3114) are provided in the reaction container (3111) in the deposition device (3100), and a high-frequency matching box (3115) is connected to the reaction container.

The source gas supply device (3200) is composed of gas cylinders (3221 to 3226), valves (3231 to 3236, 3241 to 3246, 3251 to 3256), and mass flow controllers (3211 to 3216), and each gas cylinder is connected to the gas introduction pipe (3114) in the reaction container (3111) via the valve (3260).

This apparatus is used to form a deposited film as follows. First, the cylindrical support (3112) is installed in the reaction container (3111), and the inside of the reaction container (3111) is exhausted. the exhaust device (not shown in the drawings; for example, a vacuum pump). Subsequently, the heater (3113) for heating the support heats the cylindrical support (3112) up to a predetermined temperature between 200 and 350° C.

To flow a source gas for forming a deposited film into the reaction container (3111), it is confirmed that the valves (3231 to 3237) for the gas cylinders and a leak valve (3117) for the reaction container are closed and that inflow valves (3241 to 3246), outflow valves (3251 to 3256), and a supplementary valve (3260) are open, and then a main valve (3118) is opened to exhaust the inside of the reaction container (3111) and a gas pipe (3116).

Then, when a vacuum gauge (3119) shows a reading of about $1\times10^{-2}$ Pa, the supplementary valve (3260) and outflow valves (3251 to 3256) are closed.

Subsequently, the valves (3231 to 3236) are opened to introduce each gas from the gas cylinders (3221 to 3226), and pressure regulators (3261 to 3266) are used to adjust the pressure of each gas to 2 $Kg/cm^2$. Then, the inflow valves (3241 to 3246) are gradually opened to introduce each gas into the mass flow controllers (3211 to 3216).

After the preparations for film formation have been completed as described above, each layer is formed using the following procedure.

When the cylindrical support (3112) reaches a predetermined temperature, necessary valves among the outflow valves (3251 to 3256) are gradually opened to introduce predetermined gases from the gas cylinders (3221 to 3226) into the reaction container (3111) via the gas introduction pipe (3114). Then, the mass flow controllers (3211 to 3216) are used to adjust each source gas to a predetermined flow rate. In this case, the opening of the main valve (3118) is adjusted while viewing the vacuum gauge (3119) so that the pressure of the reaction container (3111) has a predetermined value of $1.5\times10^{2}$ Pa or less. Once the internal pressure has stabilized, a 13.56 MHz RF power supply (not shown in the drawings) is set at a desired power to introduce an RF power into the reaction container (3111) through the high-frequency matching box (3115), thereby causing glow discharge. This discharge energy decomposes source gases introduced into the reaction container to form a deposited film comprising predetermined silicon as a main component on the cylindrical support (3112). After a film having a desired thickness has been formed, the supply of RF power is stopped and the outflow valves are closed to turn off the inflow of the gases to finish the formation of the deposited film.

A similar operation is repeated several times to form a light-receiving layer of a desired multilayer structure.

Of course, all outflow valves other than outflow valves for necessary gases are closed in formation of each layer. Also, to avoid allowing the gases to remain in the reaction container (3111) and the piping from the outflow valves (3251 to 3256) to the reactive container (3111), the outflow valves (3251 to 3256) are closed, the supplementary valve (3260) is opened, and the main valve (3118) is fully opened to exhaust the inside of the system down to a high vacuum as required.

In addition, to uniformly form a film, a driving device (not shown in the drawings) can be effectively used to rotate the support (3112) at a predetermined speed.

Furthermore, of course, the gas species mentioned above and valve operations can be changed depending on the production conditions for each layer.

In the above method, the temperature of the support during the formation of the deposited film is between 200 and 350° C., preferably between 230 and 330° C., more preferably between 250 and 310° C. The heating of the support may be conducted by using any heating element for use under vacuum, a electrically-resistant heating element such as a sheeth-like winding heater, a plate-like heater, or a ceramic heater; a heat-radiating lamp heating element such as a halogen lamp or an infrared lamp; or a heating element utilizing a heat exchanging means by using a liquid or a gas as a heating medium. The material of the surface of the heating means is metal such as stainless steel, nickel, aluminum, or copper; ceramics, or heat-resistant polymeric resin.

In an alternative method, a container only for heating other than the reaction container is provided and hearing is carried out in the container only for heating, and then the support is transferred to the reaction container under vacuum.

The effects of this invention are described below using Experiment Examples.

EXPERIMENT EXAMPLE 1

A light-receiving member manufacturing apparatus by using the RF-PCVD method, which is shown in FIG. 4, was used to produce a light-receiving member by forming films, that is, a charge injection inhibiting layer, a photoconductive layer, and a surface layer in this order on a mirror-finished aluminum cylinder (support) of diameter 108 mm under the conditions shown in Table 1. The photoconductive layer consisted of a third layer region having a thickness capable of absorbing 70% of 680 nm light; a second layer region having a thickness obtained by subtracting the thickness of the third layer region from the thickness of a layer region capable of absorbing 90% of 700 nm light; and a first layer region being a region other than the second and third layer regions, these layer regions being arranged in this order from the surface side toward the support side. In addition, $B_2H_6$ was used as a gas species containing a Group IIIb element, and the content of this Group IIIb element was adjusted relative to silicon atoms.

Instead of the aluminum cylinder, a cylindrical sample holder with grooves for arranging a sample substrate thereon was used to deposit an a-Si film of about 1 μm thickness on a glass substrate (Coning Inc., 7059) and an Si wafer under the above photoconductive-layer producing conditions. The film deposited on the glass substrate was measured for an optical band gap (Eg), a comb-like Cr electrode was then vapor-deposited thereon, and CPM was used to measure the characteristic energy (Eu) of the Urbach tail. The film deposited on the Si wafer was measured for the hydrogen content (Ch) using FTIR.

In one light-receiving member produced according to Table 1, Ch, Eg and Eu of the photoconductive layer thereof were 23 atomic %, 1.81 eV and 60 meV, respectively (condition (a)).

Then, in Table 1, the mixing ratio of $SiH_4$ gas to $H_2$ gas, the ratio of $SiH_4$ gas to discharge power and the temperature of the support were varied to produce various light-receiving members in which the Ch, Eg and Eu of the photoconductive layer were 10 atomic %, 1.75 eV and 55 meV (condition (b)); 26 atomic %, 1.83 eV and 62 meV (condition (c)); 30 atomic %, 1.85 eV and 65 meV (condition ((d)). That is, various light-receiving members were produced which had a photoconductive layer with Ch, Eg and Eu being in a range of 10 to 30 atomic %, 1.75 eV to 1.85 eV, and 55 meV to 65 meV, respectively.

The produced light-receiving members were set in an electrophotographic apparatus (Canon NP-6650 modified for experiments) to evaluate their potential characteristic. In this case, the process speed was set to 380 mm/sec., pre-exposure light (an LED of 700 nm wavelength) was set to 4 lux·sec., and image exposure light (an LED of 680 nm wavelength) was set. Under the current value of a charger being 1,000 μA, the surface potential of the light-receiving member was measured by using a potential sensor of a surface potentiometer (TREK Inc., Model 344) set at the position of a developing unit in the electrophotographic apparatus, and a measured value was defined as a chargeability. Under the image exposure light of 1.5 lux·sec., the surface potential was measured and a measured value was defined as a residual potential.

The chargeability was also measured under the above conditions while varying the temperature from the room temperature (about 25° C.) to 50° C. by using a drum is heater built into the light-receiving member. The variation of the chargeability per the temperature of 1° C. was defined as a temperature characteristic.

The charging condition was set so that the dark potential would be 400 V at both the room temperature and 45° C., and the E-V characteristic (curve) was measured to evaluate the temperature characteristic of sensitivity and the linearity of sensitivity.

Furthermore, a memory potential was measured by using a similar potential sensor under the above conditions as the difference between the surface potential during a non-image-exposure state and the surface potential at the time of charging again after conducting image exposure once.

Subsequently, halftone image, character original and photograph original were used to evaluate the image characteristics.

The potential characteristics of the photoconductive layer (total film thickness: 30 μm) was composed only of the first, second, or third layer regions were defined as 1 in order to relatively evaluate the chargeability, residual potential, temperature characteristic, memory potential, and temperature characteristic of sensitivity and linearity of sensitivity.

[Chargeability]

◎: Increase by 20% or more in comparison with the photoconductive layer (total film thickness: 30 μm) composed only of the first, second or third layer region ○: Increase by 10% to 20% in comparison with the photoconductive layer (total film thickness: 30 μm) composed only of the first, second or third layer region Δ: Equivalent to the chargeability of the photoconductive layer (total film thickness: 30 μm) composed only of the first, second or third layer region x: Decrease in comparison with the photoconductive layer (total film thickness: 30 μm) composed only of the first, second or third layer region

[Residual Potential, Temperature Characteristic, Memory Potential, Temperature Characteristic of Sensitivity and Linearity of Sensitivity]

◎: Decrease by 30% or more in comparison with to the photoconductive layer (total film thickness: 30 μm) composed only of the first, second or third layer region ○: Decrease by 10% to 30% in comparison with the photoconductive layer (total film thickness: 30 μm) composed only of the first, second or third layer region Δ: Equivalent to these characteristics of the photoconductive layer (total film thickness: 30 μm) composed only of the first, second or third layer region x: Increase in comparison with the photoconductive layer (total film thickness: 30 μm) composed only of the first, second or third layer region Obtained results are shown in Tables 2, 3 and 4.

Tables 2 to 4 clearly show that the photoconductive layers according to this invention were more excellent than the photoconductive layer (total film thickness: 30 μm) composed only of the first, second or third layer regions in terms of all of the chargeability, temperature characteristic, memory potential, and temperature characteristic and linearity of sensitivity and that they could produce uniform halftone images having excellent characteristics without uneven density. Furthermore, when character original was copied, clear images of a high black density were obtained. When photograph original was copied, clear images faithful to the original were obtained. In addition, the same effects were obtained when a semiconductor laser (wavelength: 680 nm) was used instead of the image exposure light source.

EXPERIMENT EXAMPLE 2

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm under the same condition as the condition (a) of Experiment Example 1. In this case, however, the thickness of the third layer region was varied so that the third layer region can absorb 40% (condition (a)), 50% (condition (b)), 80% (condition (c)), 90% (condition (d)) and 92% (condition (e)) of 680 nm image exposure light.

For each of the produced light-receiving members, the characteristics of the photoconductive layer (total film thickness: 30 μm) composed only of the first layer region was defined as 1 in order to relatively evaluate the chargeability, residual potential, temperature characteristic, memory potential, and temperature characteristic and linearity of sensitivity, in the same manner as in Experiment Example 1.

Obtained results are shown in Table 5. This table clearly shows that when the third layer region could absorb 50 to 90% of image exposure light, the effects of this invention were obtained and images having excellent image characteristics were also obtained similarly as in Experiment Example 1. In addition, the same effects were obtained when a semiconductor laser (wavelength: 680 nm) was used as the image exposure light source instead of LED.

EXPERIMENT EXAMPLE 3

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm under the same condition as the condition (a) of Experiment Example 1. In this case, however, the third layer region had a fixed thickness capable of absorbing 55% of 680 nm image exposure light, while the thickness of the second layer region was varied so that the second layer region had a thickness obtained by subtracting the thickness of the third layer region from a layer region capable of absorbing 55% (condition (a)), 60% (condition (b)), 80% (condition (c)), 90% (condition (d)) or 92% (condition (e)) of pre-exposure light.

For each of the produced light-receiving members, the characteristics of the photoconductive layer (total film thickness: 30 μm) composed only of the first layer region was defined as 1 in order to relatively evaluate the chargeability, residual potential, temperature characteristic, memory potential, and temperature characteristic and linearity of sensitivity, in the same manner as in Experiment Example 1.

Obtained results are shown in Table 6. This table clearly shows that when the second layer region was other than the third layer region of a layer region that could absorb 60% to 90% of pre-exposure light, the effects of this invention were obtained and images having excellent image characteristics were also obtained similarly as in Experiment Example 1. In addition, similar effects were obtained when a semiconductor laser (wavelength: 680 nm) was used as the image exposure light source instead of LED.

EXPERIMENT EXAMPLE 4

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm under the same condition as the condition (b) of Experiment Example 1. In this case, however, the contents of the Group IIIb element in the first and second layer regions were 7 and 6 ppm, respectively, relative to silicon atoms, and the content of the Group IIIb element in the third layer region was varied to be 0.01 ppm, 0.03 ppm, 0.1 ppm, 2 ppm, 5 ppm and 5.5 ppm relative to silicon atoms. In this case, $B_2H_6$ was used as a gas species containing the Group IIIb element to adjust the content of this element relative to silicon atoms.

For each of the produced light-receiving members, the characteristics of the photoconductive layer (total film thickness: 30 μm) composed only of the first layer region produced in Experiment Example 4 was defined as a standard in order to relatively evaluate the chargeability, residual potential, temperature characteristic, memory potential, and temperature characteristic and linearity of sensitivity, in the same manner as in Experiment Example 1.

Obtained results are shown in Table 7. These results clearly show that when the content of the Group IIIb element in the third layer region was 0.03 ppm to 5 ppm relative to silicon atoms, the effects of this invention were obtained and images having excellent image characteristics were also obtained similarly as in Experiment Example 1. In addition, similar effects were obtained when a semiconductor laser (wavelength: 680 nm) was used as the image exposure light source instead of LED.

EXPERIMENT EXAMPLE 5

The light-receiving member manufacturing apparatus using the RF-PCVD method which is shown in FIG. 4 was used to produce a light-receiving member by forming films, that is, a charge injection inhibiting layer, a photoconductive layer, and a surface layer in this order on a mirror-finished aluminum cylinder (support) of diameter 108 mm under the same condition as the condition (c) of Experiment Example 1. In this case, however, the contents of the Group IIIb element in the first and third layer regions were 13 ppm and 0.13 ppm, respectively, relative to silicon atoms, and the content of the group IIIb element in the second layer region was varied to be 0.15 ppm, 0.2 ppm, 2 ppm, 10 ppm and 12 ppm relative to silicon atoms. In this case, $B_2H_6$ was used as a gas species containing the Group IIIb element to adjust the content of this element relative to silicon atoms.

For each of the produced light-receiving members, the characteristics of the photoconductive layer (total film thickness: 30 $\mu$m) composed only of the first layer region produced in Experiment Example 5 was defined as 1 in order to relatively evaluate the chargeability, residual potential, temperature characteristic, memory potential, and temperature characteristic and linearity of sensitivity, in the same manner as in Experiment Example 1.

Obtained results are shown in Table 8. These results clearly show that when the content of the Group IIIb element in the second layer region was 0.2 ppm to 10 ppm relative to silicon atoms, the effects of this invention were obtained and images having excellent image characteristics were also obtained similarly as in Experiment Example 1. In addition, the same effects were obtained when a semiconductor laser (wavelength: 680 nm) was used as the image exposure light source instead of LED.

EXPERIMENT EXAMPLE 6

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm under the same condition as the condition (d) of Experiment Example 1. In this case, however, the contents of the Group IIIb element in the first and second layer regions were fixed at 8 ppm and 6 ppm, respectively, relative to silicon atoms, and the ratio of the content of the Group IIIb element in the second layer region relative to silicon atoms to the content of the Group IIIb element in the third layer region relative to silicon atoms was varied to be 600 (condition (a)), 200 (condition (b)), 80 (condition (c)), 3 (condition (d)), 1.2 (condition (e)) and 1.1 (condition (f)). In this case, $B_2H_6$ was used as a gas species containing the Group IIIb element to adjust the content of this element relative to silicon atoms.

For each of the produced light-receiving members, the characteristics of the photoconductive layer (total film thickness: 30 $\mu$m) composed only of the first layer region produced in Experiment Example 6 was defined as 1 in order to relatively evaluate the chargeability, residual potential, temperature characteristic, memory potential, and temperature characteristic and linearity of sensitivity, in the same manner as in Experiment Example 1.

Obtained results are shown in Table 9. These results clearly show that when the ratio of the content of the Group IIIb element in the second layer region relative to silicon atoms to the content of the Group IIIb element in the third layer region relative to silicon atoms was 1.2 to 200, the effects of this invention were obtained and images having excellent image characteristics were also obtained similarly as in Experiment Example 1. In addition, similar effects were obtained when a semiconductor laser (wavelength: 680 nm) was used as the image exposure light source instead of LED.

EXPERIMENT EXAMPLE 7

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (a support) of diameter 108 mm under the same condition as the condition (d) of Experiment Example 1. In this case, however, the contents of the Group IIIb element in the second and third layer regions were 0.4 ppm and 0.3 ppm, respectively, relative to silicon atoms, and the content of the Group IIIb element in the first layer region was varied to be 0.5 ppm, 1 ppm, 5 ppm, 15 ppm, 25 ppm and 30 ppm relative to silicon atoms. In this case, $B_2H_6$ was used as a gas species containing the Group IIIb element to adjust the content of this element relative to silicon atoms.

For each of the produced light-receiving members, the characteristics of the photoconductive layer (total film thickness: 30 $\mu$m) composed only of the second layer region produced in Experiment Example 7 was defined as 1 in order to relatively evaluate the chargeability, residual potential, temperature characteristic, memory potential, and temperature characteristic and linearity of sensitivity, in the same manner as in Experiment Example 1.

Obtained results are shown in Table 10. These results clearly show that when the content of the Group IIIb element in the first layer region was 1 ppm to 25 ppm relative to silicon atoms, the effects of this invention were obtained and images having excellent image characteristics were also obtained similarly as in Experiment Example 1. In addition, the same effects were obtained when a semiconductor laser (wavelength: 680 nm) was used as the image exposure light source instead of LED.

EXPERIMENT EXAMPLE 8

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm. In this case, the photoconductive layer shown in Table 1 in respect of Experiment Example 1 was formed as follows.

(A) The content of the Group IIIb element relative to the silicon atoms in the first layer region was varied from 3 ppm to 2 ppm from the charge injection inhibiting layer side (support side) toward the surface layer side (light incidence side) as shown in FIGS. 5A to 5E, and the contents of the Group IIIb element in the second and third layer regions were set to 0.5 ppm and 0.1 ppm, respectively, relative to silicon atoms.

(B) The content of the Group IIIb element relative to the silicon atoms in the first layer region was varied from 3 ppm to 2 ppm from the charge injection inhibiting layer side (support side) toward the surface layer side (light incidence side) as shown in FIGS. 5A to 5E. Then, in each of the above cases, the content of the group IIIb element relative to silicon atoms in the second layer region was varied from 0.5 ppm to 0.3 ppm from the photoconductive layer side (support side) toward the surface layer side (light incidence side) as shown in FIGS. 5A to 5E. Further, in each of the above cases, the content of the Group IIIb element relative to the silicon atoms in the third layer region was varied from 0.2 ppm to 0.1 ppm from the photoconductive layer side (support side) toward the surface layer side (light incidence side) as shown in FIGS. 5A to 5E.

The produced light-receiving members were evaluated in the same manner as in Experiment Example 1, excellent effects were obtained in all of the chargeability, residual potential, temperature characteristic, memory potential, temperature characteristic and linearity of sensitivity, and image characteristics, similarly as in Experiment Example 1, and images having excellent image characteristics were also obtained similarly as in Experiment Example 1. In addition, the same effects were obtained when a semiconductor laser (wavelength: 680 nm) was used as the image exposure light source instead of LED.

EXPERIMENT EXAMPLE 9

A light-receiving member manufacturing apparatus using the RF-PCVD method, which is shown in FIG. 4, was used to produce a light-receiving member by forming films, that is, a charge injection inhibiting layer, a photoconductive layer and a surface layer in this order on a mirror-finished aluminum cylinder (support) of diameter 108 mm under the conditions shown in Table 11. The photoconductive layer consisted of a third layer region having a thickness capable of absorbing 70% of 680 nm light; a second layer region having a thickness obtained by subtracting the thickness of the third layer region from the thickness of a layer region capable of absorbing 90% of 700 nm light; and a first layer region being a layer region other than the second and third layer regions, the layer regions being arranged in this order from the surface side toward the support side. In addition, $B_2H_6$ was used as a gas species containing a Group IIIB element, and the content of this Group IIIb element was adjusted relative to silicon elements.

Instead of the aluminum cylinder, a cylindrical sample holder with grooves for arranging a sample substrate was used to deposit an a-Si film of about 1 $\mu$m thickness on a glass substrate (Coning Inc., 7059) and an Si wafer under the above conditions for producing a photoconductive layer. The film deposited on the glass substrate was measured for an optical band gap (Eg), a comb-like Cr electrode was then vapor-deposited thereon, and CPM was used to measure the characteristic energy (Eu) of the Urbach tail. The film deposited on the Si wafer was measured for the hydrogen content (Ch) using FTIR.

In one light-receiving member produced according to Table 11, Ch, Eg and Eu of the photoconductive layer thereof were 20 atomic %, 1.75 eV, and 55 meV, respectively (condition (a)). Then, in Table 11, the mixing ratio of $SiH_4$ gas to $H_2$ gas, the ratio of $SiH_4$ gas to discharge power, and the temperature of the support were varied to produce various light-receiving members in which the Ch, Eg and Eu of the photoconductive layer were 10 atomic %, 1.65 eV, and 50 mev (condition (b)); 15 atomic %, 1.70 eV, and 52 meV (condition (c)); 18 atomic %, 1.73 eV, and 53 meV (condition (d)). That is, the various light-receiving members were produced which had a photoconductive layer with Ch, Eg and Eu being 10 to 20 atomic %, 1.65 to 1.75 eV, and 50 to 55 meV, respectively. These light-receiving members produced under the conditions (a) to (d) were evaluated similarly as in Experiment Example 1, excellent results were obtained in all of the chargeability, residual potential, temperature characteristic, memory potential, temperature characteristic and linearity of sensitivity, and image characteristics, similarly as in Experiment Example 1. In addition, the same effects were obtained when a semiconductor laser (wavelength: 680 rn) was used as the image exposure light source instead of LED.

EXPERIMENT EXAMPLE 10

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm under the same condition as the condition (a) of Experiment Example 9. In this case, however, the thickness of the third layer region was varied so that third layer region can absorb 40% (condition (a)), 50% (condition (b)), 80% (condition (c)), 90% (condition (d)) and 92% (condition (e)) of 680 nm image exposure light, respectively.

The light-receiving members produced under the conditions (a) to (e) were evaluated for the chargeability, residual potential, temperature characteristic, memory potential, temperature characteristic and linearity of sensitivity, and image characteristics in the same manner as in Experiment Example 2. It was then found that when the third layer region had a thickness capable of absorbing 50% to 90% of image exposure light, the effects of this invention were obtained and images having excellent image characteristics were also obtained similarly as in Experiment Example 2. In addition, the same effects were obtained when a semiconductor laser (wavelength: 680 nm) was used as the image exposure light source instead of LED.

EXPERIMENT EXAMPLE 11

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm under the same condition as the condition (b) of Experiment Example 9. In this case, however, the third layer region had a fixed thickness capable of absorbing 55% of 680 nm image exposure light, while the thickness of the second layer region was varied so that the second layer region had a thickness obtained by subtracting the thickness of the third layer region from the thickness of a layer region that could absorb 55% (condition (a)), 60% (condition (b)), 80% (condition (c)), 90% (condition (d)) and 92% (condition (e)) of pre-exposure light, respectively.

The produced light-receiving members were individually evaluated for the chargeability, residual potential, temperature characteristic, memory potential, temperature characteristic and linearity of sensitivity, and image characteristics in the same manner as in Experiment Example 3. It was then found that when the second layer region had a thickness capable of absorbing 60% to 90% of image exposure light, the effects of this invention were obtained and images having excellent image characteristics were also obtained similarly as in Experiment Example 3. In addition, the same effects were obtained when a semiconductor laser (wavelength: 680 nm) was used as the image exposure light source instead of the image exposure light source.

EXPERIMENT EXAMPLE 12

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm under the same condition as the condition (b) of Experiment Example 9. In this case, however, the contents of the Group IIIb element in the first and second layer regions were 7 ppm and 6 ppm, respectively, relative to silicon atoms, and the content of the Group IIIb element in the third layer region was varied to be 0.01 ppm, 0.03 ppm, 0.1 ppm, 2 ppm, 5 ppm and 5.5 ppm relative to silicon atoms. In this case, $B_2H_6$ was used as a gas species containing the Group IIIb element to adjust the content of this element relative to silicon atoms.

The produced light-receiving members were individually evaluated for the chargeability, residual potential, temperature characteristic, memory potential, temperature characteristic and linearity of sensitivity, and image characteristics in the same manner as in Experiment Example 4. It was then found that when the content of the Group IIIb element in the third layer region was 0.03 ppm to 5 ppm relative to silicon atoms, the effects of this invention were obtained and images having excellent image characteristics were also obtained similarly as in Experiment Example 4. In addition, the same effects were obtained when a semiconductor laser (wavelength: 680 nm) was used as the image exposure light source instead of LED.

EXPERIMENT EXAMPLE 13

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm under the same condition as the condition (c) of Experiment Example 9. In this case, however, the contents of the Group IIIb element in the first and third layer regions were 13 ppm and 0.13 ppm, respectively, relative to silicon atoms, and the content of the Group IIIb element in the second layer region was varied to be 0.15 ppm, 0.2 ppm, 2 ppm, 10 ppm and 12 ppm relative to silicon atoms. In this case, $B_2H_6$ was used as a gas species containing the Group IIIb element to adjust the content of this element relative to silicon atoms.

The produced light-receiving members were individually evaluated for the chargeability, residual potential, temperature characteristic, memory potential, temperature characteristic and linearity of sensitivity, and image characteristics, in the same manner as in Experiment Example 5. It was then found that when the content of the Group IIIb element in the second layer region was 0.2 ppm to 10 ppm relative to silicon atoms, the effects of this invention were obtained and images having excellent image characteristics were also obtained similarly as in Experiment Example 1. In addition, similar effects were obtained when a semiconductor laser (wavelength: 680 nm) was used as the image exposure light source instead of LED.

EXPERIMENT EXAMPLE 14

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm under the same condition as the condition (d) of Experiment Example 9. In this case, however, the contents of the Group IIIb element in the first and second layer regions were fixed to 8 ppm and 6 ppm, respectively, relative to silicon atoms, and the ratio of the content of the Group IIIb element in the second layer region relative to silicon atoms to the content of the Group IIIb element in the third region relative to silicon atoms was varied to be 600 (condition (a)), 200 (condition (b)), 80 (condition (c)), 3 (condition (d)), 1.2 (condition (e)) and 1.1 (condition (f)). In this case, $B_2H_6$ was used as a gas species containing the Group IIIb element to adjust the content of this element relative to silicon atoms.

The produced light-receiving members were individually evaluated for the chargeability, residual potential, temperature characteristic, memory potential, temperature characteristic and linearity of sensitivity, and image characteristics, in the same manner as in Experiment Example 6. It was then found that when the ratio of the content of the Group IIIb element to the silicon atoms in the second layer region to the content of the Group IIIb element to the silicon atoms in the third layer region was 1.2 to 200, the effects of this invention were obtained and images having excellent image characteristics were also obtained similarly as in Experiment Example 1. In addition, similar effects were obtained when a semiconductor laser (wavelength: 680 nm) was used as the image exposure light source instead of LED.

EXPERIMENT EXAMPLE 15

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm under the same condition as the condition (d) of Experiment Example 9. In this case, however, the contents of the Group IIIb element in the second and third layer regions were fixed to 0.4 ppm and 0.3 ppm, respectively, relative to silicon atoms, and the content of the Group IIIb element in the first layer region was varied to be 0.5 ppm, 1 ppm, 5 ppm, 15 ppm, 25 ppm and 30 ppm relative to silicon atoms. In this case, $B_2H_6$ was used as a gas species containing the Group IIIb element to adjust the content of this element relative to silicon atoms.

The produced light-receiving members were individually evaluated for the chargeability, residual potential, temperature characteristic, memory potential, temperature characteristic and linearity of sensitivity, and image characteristics, in the same manner as in Experiment Example 7. It was then found that when the content of the Group IIIB element in the first layer region was 1 ppm to 25 ppm relative to silicon atoms, the effects of this invention were obtained and images having excellent image characteristics were also obtained similarly as in Experiment Example 1. In addition, the same effects were obtained when a semiconductor laser (wavelength: 680 nm) was used as the image exposure light source instead of LED.

EXPERIMENT EXAMPLE 16

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm. In this case, the photoconductive layer shown in Table 11 in respect of Experiment Example 9 was formed as follows:

(A) The content of the Group IIIb element relative to the silicon atoms in the first layer region was varied from 3 ppm to 2 ppm from the charge injection inhibiting layer side (support side) toward the surface layer side (.light incidence side) as shown in FIGS. 5A to 5E, and the contents of the Group IIIb element in the second and third layer regions were set to 0.5 ppm and 0.1 ppm, respectively, relative to silicon atoms.

(B) The contents of the Group IIIb element in the first and third layer regions were set to 2 ppm and 0.05 ppm, respectively, relative to silicon atoms, and the content of the Group IIIb element relative to the silicon atoms in the second layer region was varied from 0.5 ppm to 0.3 ppm from the photoconductive layer side (support side) toward the surface layer side (light incidence side) as shown in FIGS. 5A to 5E.

(C) The contents of the Group IIIb element in the first and second layer regions were set to 2 ppm and 0.5 ppm, respectively, relative to silicon atoms. The content of the Group IIIb element relative to silicon atoms in the third layer region was varied from 0.4 ppm to 0.1 ppm from the photoconductive layer side (support side) toward the surface layer side (light incidence side) as shown in FIGS. 5A to 5E.

(D) The content of the Group IIIb element relative to the silicon atoms in the first layer region was varied from 3 ppm to 2 ppm from the charge injection inhibiting layer side (support side) toward the surface layer side (light incidence side) as shown in FIGS. 5A to 5E. Then, in each of the above cases, the content of the Group IIIb element relative to the silicon atoms in the second layer region was varied from 0.5 ppm to 0.3 ppm from the photoconductive layer side (support side) toward the surface layer side (light incidence side) as shown in FIGS. 5A to 5E. Further, in each of the above cases, the content of the Group IIIb element relative to the silicon atoms in the third layer region was varied from 0.2 ppm to 0.1 ppm from the photoconductive layer side (support side) toward the surface layer side (light incidence side) as shown in FIGS. 5A to 5E.

The produced light-receiving members were evaluated in the same manner as in Experiment Example 1, it was then found that excellent effects were obtained in all of the chargeability, residual potential, temperature characteristic, memory potential, temperature characteristic and linearity of sensitivity, and image characteristics, similarly as in Experiment Example 1, and images having excellent image characteristics were also obtained similarly as in Experiment Example 1. In addition, similar effects were obtained when a semiconductor laser (wavelength: 680 nm) was used as image exposure light source instead of the LED.

EXPERIMENT EXAMPLE 17

A light-receiving member manufacturing apparatus using the RF-PCVD method, which is shown in FIG. 4, was used to produce a light-receiving member by forming films, that is, a charge injection inhibiting layer, a photoconductive layer and a surface layer in this order on a mirror-finished aluminum cylinder (support) of diameter 108 mm under the conditions shown in Table 12. The photoconductive layer consisted of a third layer region having a thickness capable of absorbing 70% of 680 nm light; a second layer region having a thickness obtained by subtracting the thickness of the third layer region from the thickness of a layer region capable of absorbing 90t of 700 nm light; and a first layer region being a layer region other than the second and third layer regions, the layer regions being arranged in this order from the surface side toward the support side. In addition, $B_2H_6$ was used as a gas species containing a Group IIIb element, and the content of this Group IIIb element was adjusted relative to silicon elements.

Instead of the aluminum cylinder, a cylindrical sample holder with grooves for arranging a sample substrate was used to deposit an a-Si film of about 1 $\mu$m thickness on a glass substrate (Coning Inc., 7059) and an Si wafer under the above conditions for producing a photoconductive layer. The film deposited on the glass substrate was measured for an optical band gap (Eg), a comb-like Cr electrode was then vapor-deposited thereon, and CPM was used to measure the characteristic energy (Eu) of the Urbach tail. The film deposited on the Si wafer was measured for the hydrogen content (Ch) using FTIR.

In one light-receiving member produced according to Table 1, Ch, Eg and Eu of the photoconductive layer thereof were 30 atomic %, 1.84 eV and 53 meV, respectively (condition (a)).

Then, in Table 12, the mixing ratio of $SiH_4$ gas to $H_2$ gas, the ratio of $SiH_4$ gas to discharge power, and the temperature of the support were varied to produce various light-receiving members in which the Ch, Eg and Eu of the photoconductive layer were 25 atomic %, 1.80 eV and 50 meV (condition (b)); 33 atomic %, 1.85 eV and 54 meV (condition (c)); 40 atomic %, 1.90 eV and 55 meV (condition (d)), respectively. That is, the light-receiving members were produced which had a photoconductive layer with Ch, Eg and Eu being 25 atomic % to 40 atomic %, 1.80 eV to 1.90 eV and 50 meV to 55 meV, respectively. When these light-receiving members produced under the conditions (a) to (d) were evaluated similarly as in Experiment Example 1, excellent results were obtained in all of the chargeability, residual potential, temperature characteristic, memory potential, temperature characteristic and linearity of sensitivity, and image characteristics, similarly as in Experiment Example 1. In addition, the same effects were obtained when a semiconductor laser (wavelength: 680 nm) was used as the image exposure light source instead of LED.

EXPERIMENT EXAMPLE 18

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm under the same condition as the condition (a) of Experiment Example 17. In this case, however, the thickness of the third layer region was varied so that the third layer region can absorb 40% (condition (a)), 50% (condition (b)), 80% (condition (c)), 90% (condition (d)) and 92% (condition (e)) of 680 nm image exposure light.

The light-receiving members produced under the A conditions (a) to (e) were evaluated for the chargeability, residual potential, temperature characteristic, memory potential, temperature characteristic and linearity of sensitivity, and image characteristics in the same manner as in Experiment Example 2. It was then found that when the third layer region had a thickness capable of absorbing 50% to 90% of image exposure light, the effects of this invention were obtained and images having excellent image characteristics were also obtained similarly as in Experiment Example 2. In addition, the same effects were obtained when a semiconductor laser (wavelength: 680 nm) was used as the image exposure light source instead of LED.

EXPERIMENT EXAMPLE 19

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm under the same condition (b) of Experiment Example 17. In this case, however, the third layer region had a fixed thickness capable of absorbing 55% of 680 nm image exposure, while the thickness of the second layer region was varied so as to become a thickness obtained by subtracting the thickness of the third layer region from the thickness of a layer region capable of absorbing 55% (condition (a)), 60% (condition (b)), 80% (condition (c)), 90% (condition (d)) and 92% (condition (e)) of pre-exposure light.

The produced light-receiving members were individually evaluated for the chargeability, residual potential, temperature characteristic, memory potential, temperature characteristic and linearity of sensitivity, and image characteristics in the same manner as in Experiment Example 3. It was then found that when the second layer region had a thickness capable of absorbing 60% to 90% of image exposure light, the effects of this invention were obtained and images having excellent image characteristics were also obtained similarly as in Experiment Example 3. In addition, the same effects were obtained when a semiconductor laser (wavelength: 680 nm) was used as the image exposure light source instead of LED.

EXPERIMENT EXAMPLE 20

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm under the same condition as the condition (b) of Experiment Example 17. In this case, however, the contents of the Group IIIb element in the first and second layer regions were 7 ppm and 6 ppm, respectively, relative to silicon atoms, and the content of the Group IIIb element in the third layer region was varied to be 0.01 ppm, 0.03 ppm, 0.1 ppm, 2 ppm, 5 ppm and 5.5 ppm relative to silicon atoms. In this case, $B_2H_6$ was used as a gas species containing the Group IIIb element to adjust the content of this element relative to silicon atoms.

The produced light-receiving members were individually evaluated for the chargeability, residual potential, temperature characteristic, memory potential, temperature characteristic and linearity of sensitivity, and image characteristics in the same manner as in Experiment Example 4. It was then found that when the content of the Group IIIb element in the third layer region was 0.03 ppm to 5 ppm relative to silicon atoms, the effects of this invention were obtained and images having excellent image characteristics were also obtained similarly as in Experiment Example 4. In addition, the same effects were obtained when a semiconductor laser (wavelength: 680 nm) was used as the image exposure light source instead of LED.

EXPERIMENT EXAMPLE 21

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm under the same condition as the condition (c) of Experiment Example 17. In this case, however, the contents of the Group IIIb element in the first and third layer regions were 13 ppm and 0.13 ppm, respectively, relative to silicon atoms, and the content of the Group IIIb element in the second layer region was varied to be 0.15 ppm, 0.2 ppm, 2 ppm, 10 ppm and 12 ppm relative to silicon atoms. In this case, $B_2H_6$ was used as a gas species containing the group IIIb element to adjust the content of this element relative to silicon atoms.

The produced light-receiving members were individually evaluated for the chargeability, residual potential, temperature characteristic, memory potential, temperature characteristic and linearity of sensitivity, and image characteristics in the same manner as in Experiment Example 5. It was then found that when the content of the Group IIIb element in the second layer region was 0.2 ppm to 10 ppm relative to silicon atoms, the effects of this invention were obtained and images having excellent image characteristics were also obtained similarly as in Experiment Example 1. In addition, the same effects were obtained when a semiconductor laser (wavelength: 680 nm) was used as the image exposure light source instead of LED.

EXPERIMENT EXAMPLE 22

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm under the same condition as the condition (d) of Experiment Example 17. In this case, however, the contents of the Group IIIb element in the first and second layer regions were fixed at 8 ppm and 6 ppm, respectively, relative to silicon atoms, and the ratio of the content of the Group IIIb element relative to silicon atoms in the second layer region to the content of the Group IIIb element relative to the silicon atoms in the third layer region was varied to be 600 (condition (a)), 200 (condition (b)), 80 (condition (c)), 3 (condition (d)), 1.2 (condition (e)) and 1.1 (condition (f)). In this case, $B_2H_6$ was used as a gas species containing the Group IIIb element to adjust the content of this element relative to silicon atoms.

The produced light-receiving members were individually evaluated for the chargeability, residual potential, temperature characteristic, memory potential, temperature characteristic and linearity of sensitivity, and image characteristics in the same manner as in Experiment Example 6. It was then found that when the ratio of the content of the Group IIIb element relative to silicon atoms in the second layer region to the content of the Group IIIb element relative to silicon atoms in the third layer region was 1.2 to 200, the effects of this invention were obtained and images having excellent image characteristics were also obtained similarly as in Experiment Example 1. In addition, the same effects were obtained when a semiconductor laser (wavelength: 680 nm) was used as the image exposure light source instead of LED.

EXPERIMENT EXAMPLE 23

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm under the same condition as the condition (d) of Experiment Example 17. In this case, however, the contents of the Group IIIb element in the second and third layer regions were fixed at 0.4 ppm and 0.3 ppm, respectively, relative to silicon atoms. The content of the Group IIIb element in the first layer region was varied to be 0.5 ppm, 1 ppm, 5 ppm, 15 ppm, 25 ppm and 30 ppm relative to silicon atoms. In this case, $B_2H_6$ was used as a gas species containing the Group IIIb element to adjust the content of this element relative to silicon atoms.

The produced light-receiving members were individually evaluated for the chargeability, residual potential, temperature characteristic, memory potential, temperature characteristic and linearity of sensitivity, and image characteristics in the same manner as in Experiment Example 7. It was then found that when the content of the Group IIIb element in the first layer region was 1 ppm to 25 ppm relative to silicon atoms, the effects of this invention were obtained and images having excellent image characteristics were also obtained similarly as in Experiment Example 1. In addition, the same effects were obtained when a semiconductor laser (wavelength: 680 ni) was used as the image exposure light source instead of LED.

EXPERIMENT EXAMPLE 24

The light-receiving member manufacturing apparatus using the RF-PCVD method which is shown in FIG. 4 was used to produce a light-receiving member by forming films, that is, a charge injection inhibiting layer, a photoconductive layer and a surface layer in this order on a mirror-finished aluminum cylinder (support) of diameter 108 mm. In this case, the photoconductive layer shown in Table 12 in respect of Experiment go Example 17 was formed as follows.

(A) The content of the Group IIIb element relative to silicon atoms in the first layer region was varied from 3 ppm to 2 ppm from the charge injection inhibiting layer side (support side) toward the surface layer side (light incidence side) as shown in FIGS. 5A to 5E, and the contents of the Group IIIb element in the second and third layer regions were set to 0.5 ppm and 0.1 ppm, respectively, relative to silicon atoms.

(B) The contents of the Group IIIb element in the first and third layer regions were set to 2 ppm and 0.05 ppm, respectively, relative to silicon atoms, and the content of the Group IIIb element relative to silicon atoms in the second layer region was varied from 0.5 ppm to 0.3 ppm from the photoconductive layer side (support side) toward the surface layer side (light incidence side) as shown in FIGS. 5A to 5E.

(C) The contents of the Group IIIb element in the first and second layer regions were set to 2 ppm and 0.5 ppm, respectively, relative to silicon atoms. The content of the Group IIIb element relative to silicon atoms in the third layer region was varied from 0.4 ppm to 0.1 ppm from the photoconductive layer side (support side) toward the surface layer side (light incidence side) as shown in FIGS. 5A to 5E.

(D) The content of the Group IIIb element relative to silicon atoms in the first layer region was varied from 3 ppm to 2 ppm from the charge injection inhibiting layer side (support side) toward the surface layer side (light incidence side) as shown in FIG. 5A to 5E, and in each case, the content of the Group IIIb element relative to silicon atoms in the second layer region was varied from 0.5 ppm to 0.3 ppm from the photoconductive layer side (support side) toward the surface layer side (light incidence side) as shown in FIGS. 5A to 5E, and in each case, the content of the Group IIIb element relative to silicon atoms in the third layer region was varied from 0.2 ppm to 0.1 ppm from the photoconductive layer side (support side) toward the surface layer side (light incidence side) as shown in FIGS. 5A to 5E.

When the produced light-receiving members were evaluated in the same manner as in Experiment Example 1, excellent effects were obtained in all of the chargeability, residual potential, temperature characteristic, memory potential, temperature characteristic and linearity of sensitivity, and image characteristics, similarly as in Experiment Example 1, and images having excellent image characteristics were also obtained similarly as in Experiment Example 1. In addition, the same effects were obtained when a semiconductor laser (wavelength: 680 nm) was used as the image exposure light source instead of LED.

Now, the present invention is more specifically explained with reference to the following Examples.

EXAMPLE 1

In this example, light-receiving members were produced which comprised in the following order a charge injection inhibiting layer, a photoconductive layer and a surface layer, by using the manufacturing apparatus shown in FIG. 4 under the conditions shown in Table 13, the surface layer being formed with uneven distribution of contents of silicon atoms and carbon atoms in the layer thickness direction. In this case, $B_2H_6$ was used as gas species containing the Group IIIb element to adjust the content of the Group IIIb element relative to silicon atoms. Here, the Ch, Eg and Eu of one photoconductive layer produced under the production conditions shown in Table 13 were 25 atomic %, 1.81 eV and 57 meV, respectively.

Then, by varying the mixing ratio of $SiH_4$ gas to $H_2$ gas, the ratio of $SiH_4$ gas to discharge power and the temperature of support in Table 13, various light-receiving members were produced which had the photoconductive layer with Ch, Eg and Eu of 22 atomic %, 1.81 eV and 60 meV (condition (a)), 10 atomic %, 1.75 eV and 55 mev (condition (b)), 28 atomic %, 1.83 eV and 62 meV (condition (c)), and 30 atomic %, 1.85 eV and 65 meV (condition (d)), respectively, that is, with Ch of 10 atomic % to 30 atomic %, Eg of 1.75 eV to 1.85 eV and Eu of 55 meV to 65 mev; various light-receiving members were produced which had the photoconductive layer with Ch, Eg and Eu of 20 atomic %, 1.75 eV and 55 meV (condition (e)), 10 atomic %, 1.65 eV and 50 mev (condition (f)), 15 atomic %, 1.70 eV and 52 meV (condition (g)), and 19 atomic %, 1.74 eV and 53 mev (condition (h)), respectively, that is, with Ch of 10 atomic % to 20 atomic %, Eg of 1.65 eV to 1.75 eV and Eu of 50 mev to 55 mev; and various light-receiving members were produced which had the photoconductive layer with Ch, Eg and Eu of 32 atomic %, 1.85 eV and 53 meV (condition (i)), 25 atomic %, 1.80 eV and 50 meV (condition (j)), 34 atomic %, 1.87 eV and 54 meV (condition (k)), and 40 atomic %, 1.90 eV and 55 meV (condition (l)), respectively, that is, with Ch of 25 atomic % to 40 atomic %, Eg of 1.80 eV to 1.90 eV and Eu of 50 meV to 55 meV.

The light-receiving members produced under the conditions (a) to (1) were evaluated in the same manner as in Experiment Example 1. They provided good results for all of chargeability, residual potential, temperature characteristic, memory potential, temperature characteristic of sensitivity, linearity of sensitivity and image characteristics, similarly as in Experiment Example 1. In addition, it was found that the same result could be obtained when using a semiconductor laser (wavelength: 680 nm) as the image exposure light source in place of the LED. That is, it was found that good electrophotographic characteristics could be obtained even when a surface layer was provided which had uneven distribution of contents of silicon atoms and carbon atoms in the layer thickness direction.

EXAMPLE 2

In this example, light-receiving members were produced which comprised in the following order a charge injection inhibiting layer, a photoconductive layer and a surface layer, by using the manufacturing apparatus shown in FIG. 4 under the conditions shown in Table 11, wherein the surface layer was produced with uneven distribution of contents of silicon atoms and carbon atoms in the layer thickness direction, and wherein all layers contained fluorine atoms, boron atoms, carbon atoms, oxygen atoms, and nitrogen atoms. In this case, $B_2H_6$ was used as gas species containing Group IIIb elements to adjust the content of the Group IIIb element relative to silicon atoms. Here, Ch, Eg, and Eu of one photoconductive layer produced under the production conditions shown in Table 14 were 23 atomic %, 1.82 eV and 56 meV, respectively. Then, similarly as in Example 1, by varying the mixing ratio of $SiH_4$ gas to $H_2$ gas, the ratio of $SiH_4$ gas to discharge power, and the temperature of support in Table 14, various light-receiving members were produced which had the photoconductive layer with Ch of 10 atomic % to 30 atomic %, Eg of 1.75 eV to 1.85 eV and Eu of 55 meV to 65 meV; with Ch of 10 atomic % to 20 atomic %, Eg of 1.65 eV to 1.75 eV and Eu of 50 meV to 55 meV; and with Ch of 25 atomic % to 40 atomic %, Eg of 1.80 eV to 1.90 eV and Eu of 50 meV to 55 meV.

The various produced light receiving members were evaluated in the same manner as in Experiment Example 1. They provided good results for all of chargeability, residual potential, temperature characteristic, memory potential, temperature characteristic of sensitivity, linearity of sensitivity and image characteristics. In addition, it was found that the same result could be obtained when using a semiconductor laser (wavelength: 680 nm) as the image exposure light source in place of the LED. That is, it was found that good electrophotographic characteristics could be obtained even when a surface layer was provided which had uneven distribution of contents of silicon atoms and carbon atoms in the layer thickness direction, and even when all layers contained fluorine atoms, boron atoms, carbon atoms, oxygen atoms, and nitrogen atoms.

EXAMPLE 3

In this example, light-receiving members were produced which comprised in the following order a charge injection inhibiting layer, a photoconductive layer and a surface layer, by using the manufacturing apparatus shown in FIG. 4 under the conditions shown in Table 15, the light-receiving member containing nitrogen atoms in place of carbon atoms. In this case, $B_2H_6$ was used as gas species containing the Group IIIb element to adjust the content of the Group IIIb element relative to silicon atoms. Here, the Ch, Eg and Eu of one photoconductive layer produced under the production conditions shown in Table 15 were 28 atomic %, 1.83 eV and 57 meV, respectively. Then, similarly as in Example 1, by varying the mixing ratio of $SiH_4$ gas to $H_2$ gas, the ratio of $SiH_4$ gas to discharge power, and temperature of support in Table 15, various light-receiving members were produced which had the photoconductive layer with Ch of 10 atomic % to 30 atomic %, Eg of 1.75 eV to 1.85 eV and Eu of 55 meV to 65 meV; with Ch of 10 atomic % to 20 atomic %, Eg of 1.65 eV to 1.75 eV and Eu of 50 meV to 55 meV; and with Ch of 25 atomic % to 40 atomic %, Eg of 1.80 eV to 1.90 eV and Eu of 50 meV to 55 meV.

The various produced light-receiving members were evaluated in the same manner as in Experiment Example 1. They provided good results for all of chargeability, residual potential, temperature characteristic, memory potential, temperature characteristic of sensitivity, linearity of sensitivity and image characteristics, similarly as in Experiment Example 1. In addition, it was found that the same result could be obtained when using a semiconductor laser (wavelength: 680 nm) as the image exposure light source in place of the LED. That is, it was found that good electrophotographic characteristics could be obtained even when there was provided a surface layer containing nitrogen atoms in place of carbon atoms.

EXAMPLE 4

In this example, light-receiving members containing nitrogen and oxygen atoms were produced which comprised in the following order a charge injection inhibiting layer, a photoconductive layer and a surface layer, by using the manufacturing apparatus shown in FIG. 4 under the conditions shown in Table 16. In this case, $B_2H_6$ was used as gas species containing the Group IIIb element to adjust the content of the Group IIIb element relative to silicon atoms. Here, the Ch, Eg and Eu of one photoconductive layer produced under the production conditions shown in Table 16 were 25 atomic t, 1.82 eV and 55 mev, respectively. Then, similarly as in Example 1, by varying the mixing ratio of $SiH_4$ gas to $H_2$ gas, the ratio of $SiH_4$ gas to discharge power, and the temperature of support in Table 16, various light-receiving members were produced which had the photoconductive layer with Ch of 10 atomic % to 30 atomic %, Eg of 1.75 eV to 1.85 eV and Eu of 55 meV to 65 mev; with Ch of 10 atomic % to 20 atomic %, Eg of 1.65 eV to 1.75 eV and Eu of 50 mev to 55 mev; and with Ch of 25 atomic % to 40 atomic %, Eg of 1.80 eV to 1.90 eV and Eu of 50 mev to 55 meV.

The various produced light-receiving members were evaluated in the same manner as in Experiment Example 1. They provided good results for all of chargeability, residual potential, temperature characteristic, memory potential, temperature characteristic of sensitivity, linearity of sensitivity and image characteristics, similarly as in Experiment Example 1. In addition, it was found that same result could be obtained when using a semiconductor laser (wavelength: 680 nm) as the image exposure light source in place of the LED. That is, it was found that good electrophotographic characteristics could be obtained even when a surface layer was provided which contained nitrogen and oxygen atoms as atoms for constituting the surface layer.

EXAMPLE 5

In this example, light-receiving members were produced by using the manufacturing apparatus shown in FIG. 4 under the conditions shown in Table 17, omitting the charge injection inhibiting layer, and forming a photoconductive layer and a surface layer in this order, wherein carbon atoms were contained in the layers by using a carbon source of $C_2H_2$ gas. In this case, $B_2H_6$ was used as gas species containing the Group IIIb element to adjust the content of the Group IIIb element relative to silicon atoms. Here, the Ch, Eg and Eu of one photoconductive layer produced under the production conditions shown in Table 17 were 22 atomic %, 1.82 eV and 58 meV, respectively. Then, similarly as in Example 1, by varying the mixing ratio of $SiH_4$ gas to $H_2$ gas, the ratio of $SiH_4$ gas to discharge power, and temperature of support in Table 17, various light-receiving members were produced which had the photoconductive with Ch of 10 atomic % to 30 atomic %, Eg of 1.75 eV to 1.85 eV and Eu of 55 meV to 65 mev; with Ch of 10 atomic % to 20 atomic %, Eg of 1.65 eV to 1.75 eV and Eu of 50 meV to 55 meV; and with Ch of 25 atomic % to 40 atomic %, Eg of 1.80 eV to 1.90 eV and Eu of 50 meV to 55 meV.

The various produced light-receiving members were evaluated in the same manner as in Experiment Example 1. They provided good results for all of chargeability, residual potential, temperature characteristic, memory potential, temperature characteristic of sensitivity, linearity of sensitivity and image characteristics, similarly as in Experiment Example 1. In addition, it was found that the same result could be obtained when using a semiconductor laser (wavelength: 680 nm) as the image exposure light source in place of the LED. That is, it was found that good electrophotographic characteristics could be obtained even when the charge injection inhibiting layer was omitted, and even when the photoconductive layer and the surface layer containing carbon atoms were formed in this order by using the carbon source of $C_2H_2$ gas.

The present invention can provide an electrophotographic light-receiving member which can substantially eliminate particularly the temperature characteristic of sensitivity and the linearity of sensitivity, and the occurrence of optical memory in the temperature region in which the light-receiving member is used, of which the temperature characteristic is significantly improved, and which is improved for stability in the use environment of the light-receiving member, whereby a high quality image with clear halftone and high resolution can be stably obtained.

Therefore, since the electrophotographic light-receiving member is adapted to have a specific constitution as described above, it can solve all problems in the conventional electrophotographic light-receiving member composed of a-Si, and, more particularly, can exhibit very excellent electrical characteristics, optical characteristics, photoconductive characteristics, image characteristics, durability, and use environment characteristics.

In particular, the electrophotographic light-receiving member according to the present invention can suppress temperature dependence of sensitivity straight line (slope, curving, or the like) and optical memory to a low level with respect to a long-wave laser and LED for digitization, have high chargeability, suppress variation of surface potential to variation of ambient environment, and have very excellent electrical potential characteristic and image characteristic by correlating and controlling hydrogen content, distribution of characteristic energy of the Urbach tail obtained from optical band gap or optical absorption spectrum, and distribution of elements belonging to Group IIIb of the periodic table that controls conductivity, while taking into account roles of a region absorbing a fixed amount of light and other regions with respect to a light incidence portion of pre-exposure light and image exposure light relating to the photoconductive layer, particularly, to the photoelectric conversion.

TABLE 1

| | Charge | Photoconductive layer | | | |
|---|---|---|---|---|---|
| | injection inhibiting layer | First layer region | Second layer region | Third layer region | Surface layer |
| Gas species and flow rate | | | | | |
| $SiH_4$ [sccm] | 200 | 200 | 200 | 200 | 10 |
| $H_2$ [sccm] | 300 | 1100 | 1100 | 1100 | |
| Content of Group IIIb elements relative to silicon atoms [ppm] | 2000 | 2 | 1.5 | 0.3 | |
| NO [sccm] | 5 | | | | |
| $CH_4$ [sccm] | | | | | 500 |
| Support temperature [° C.] | 290 | 290 | 290 | 290 | 280 |
| Pressure [Pa] | 67 | 67 | 67 | 67 | 67 |

TABLE 1-continued

| | Charge | Photoconductive layer | | | |
|---|---|---|---|---|---|
| | injection inhibiting layer | First layer region | Second layer region | Third layer region | Surface layer |
| RF power [W] | 500 | 800 | 800 | 800 | 200 |
| Film thickness [μm] | 3 | * | ** | *** | 0.5 |

*The thickness of the first layer region was obtained by subtracting the thickness of the second and third layer regions from 30 μm.

**The thickness of the second layer region was obtained by subtracting the thickness of the third layer region from the thickness of the layer region that could absorb 90% of 700 nm pre-exposure light.

***The thickness of the third layer region was a thickness sufficient to absorb 70% of 680 nm image exposure light. (Samples were measured to obtain absorptivities for 680 nm and 700 nm light)

TABLE 2

| Comparison with photoconductive layer (total film thickness: 30 μm) composed only of first layer region | (a) | (b) | (c) | (d) |
|---|---|---|---|---|
| Chargeability | ⊙ | ⊙ | ⊙ | ⊙ |
| Residual potential | ○ | ○ | ○ | ○ |
| Temperature characteristic | ⊙ | ⊙ | ⊙ | ⊙ |
| Memory potential | ⊙ | ⊙ | ⊙ | ⊙ |
| Temperature characteristic of sensitivity | ⊙ | ⊙ | ⊙ | ⊙ |
| Linearity of sensitivity | ⊙ | ⊙ | ⊙ | ⊙ |

TABLE 3

| Comparison with photoconductive layer (total film thickness: 30 μm) composed only of second layer region | (a) | (b) | (c) | (d) |
|---|---|---|---|---|
| Chargeability | ⊙ | ⊙ | ⊙ | ⊙ |
| Residual potential | ⊙ | ⊙ | ⊙ | ⊙ |
| Temperature characteristic | ⊙ | ⊙ | ⊙ | ⊙ |
| Memory potential | ⊙ | ⊙ | ⊙ | ⊙ |
| Temperature characteristic of sensitivity | ⊙ | ⊙ | ⊙ | ⊙ |
| Linearity of sensitivity | ⊙ | ⊙ | ⊙ | ⊙ |

TABLE 4

| Comparison with photoconductive layer (total film thickness: 30 μm) composed only of third layer region | (a) | (b) | (c) | (d) |
|---|---|---|---|---|
| Chargeability | ⊙ | ⊙ | ⊙ | ⊙ |
| Residual potential | ⊙ | ⊙ | ⊙ | ⊙ |
| Temperature characteristic | ⊙ | ⊙ | ⊙ | ⊙ |
| Memory potential | ⊙ | ⊙ | ⊙ | ⊙ |
| Temperature characteristic of sensitivity | ⊙ | ⊙ | ⊙ | ⊙ |
| Linearity of sensitivity | ⊙ | ⊙ | ⊙ | ⊙ |

TABLE 5

| | (a) 40% | (b) 50% | (c) 80% | (d) 90% | (e) 92% |
|---|---|---|---|---|---|
| Chargeability | Δ | ◎ | ◎ | ◎ | ◎ |
| Residual potential | ○ | ○ | ○ | ○ | Δ |
| Temperature characteristic | ○ | ◎ | ◎ | ◎ | ◎ |
| Memory potential | ○ | ◎ | ◎ | ◎ | Δ |
| Temperature characteristic of sensitivity | ○ | ◎ | ◎ | ◎ | ○ |
| Linearity of sensitivity | ○ | ◎ | ◎ | ◎ | ○ |

TABLE 6

| | (a) 50% | (b) 60% | (c) 80% | (d) 90% | (e) 92% |
|---|---|---|---|---|---|
| Chargeability | Δ | ◎ | ◎ | ◎ | ◎ |
| Residual potential | ○ | ○ | ○ | ○ | Δ |
| Temperature characteristic | ○ | ◎ | ◎ | ◎ | ◎ |
| Memory potential | ○ | ◎ | ◎ | ◎ | Δ |
| Temperature characteristic of sensitivity | ○ | ◎ | ◎ | ◎ | ○ |
| Linearity of sensitivity | ○ | ◎ | ◎ | ◎ | ○ |

TABLE 7

| Content of Group IIIb elements relative to silicon atoms | 0.01 ppm | 0.03 ppm | 0.1 ppm | 2 ppm | 5 ppm | 5.5 ppm |
|---|---|---|---|---|---|---|
| Chargeability | ◎ | ◎ | ◎ | ◎ | ○ | Δ |
| Residual potential | Δ | ○ | ○ | ○ | ○ | ◎ |
| Temperature characteristic | ◎ | ◎ | ◎ | ◎ | ○ | Δ |
| Memory potential | x | ○ | ◎ | ◎ | ○ | Δ |
| Temperature characteristic of sensitivity | Δ | ○ | ◎ | ◎ | ○ | Δ |
| Linearity of sensitivity | Δ | ○ | ◎ | ◎ | ○ | Δ |

TABLE 8

| Content of Group IIIb elements relative to silicon atoms | 0.15 ppm | 0.2 ppm | 2 ppm | 10 ppm | 12 ppm |
|---|---|---|---|---|---|
| Chargeability | Δ | ○ | ◎ | ○ | Δ |
| Residual potential | Δ | ○ | ○ | ○ | ◎ |
| Temperature characteristic | Δ | ○ | ◎ | ○ | ○ |
| Memory potential | Δ | ○ | ◎ | ◎ | ◎ |
| Temperature characteristic of sensitivity | Δ | ○ | ◎ | ○ | Δ |
| Linearity of sensitivity | Δ | ○ | ◎ | ○ | Δ |

TABLE 9

| | (a) 600 | (b) 200 | (c) 80 | (d) 3 | (e) 1.2 | (f) 1.1 |
|---|---|---|---|---|---|---|
| Chargeability | ◎ | ◎ | ◎ | ◎ | ○ | Δ |
| Residual potential | Δ | ○ | ○ | ○ | ○ | ◎ |
| Temperature characteristic | ◎ | ◎ | ◎ | ◎ | ○ | Δ |
| Memory potential | x | ○ | ◎ | ◎ | ○ | Δ |
| Temperature characteristic of sensitivity | Δ | ○ | ◎ | ◎ | ○ | Δ |
| Linearity of sensitivity | Δ | ○ | ◎ | ◎ | ○ | Δ |

TABLE 10

| | 0.5 ppm | 1 ppm | 5 ppm | 15 ppm | 25 ppm | 30 ppm |
|---|---|---|---|---|---|---|
| Chargeability | ○ | ◎ | ◎ | ◎ | ○ | Δ |
| Residual potential | Δ | ◎ | ◎ | ◎ | ◎ | ◎ |
| Temperature characteristic | ○ | ◎ | ◎ | ○ | ○ | Δ |
| Memory potential | Δ | ○ | ◎ | ◎ | ◎ | ◎ |
| Temperature characteristic of sensitivity | Δ | ○ | ◎ | ◎ | ○ | Δ |
| Linearity of sensitivity | Δ | ○ | ◎ | ◎ | ○ | Δ |

TABLE 11

| | Charge injection inhibiting layer | Photoconductive layer: First layer region | Second layer region | Third layer region | Surface layer |
|---|---|---|---|---|---|
| Gas species and flow rate | | | | | |
| $SiH_4$ [sccm] | 200 | 100 | 100 | 100 | 10 |
| $H_2$ [sccm] | 300 | 800 | 800 | 800 | |
| Content of Group IIIb elements relative to silicon atoms [ppm] | 2000 | 2 | 1.5 | 0.3 | |
| NO [sccm] | 5 | | | | |
| $CH_4$ [sccm] | | | | | 500 |
| Support temperature [° C.] | 290 | 290 | 290 | 290 | 280 |
| Pressure [Pa] | 67 | 67 | 67 | 67 | 67 |
| RF power [W] | 500 | 100 | 100 | 100 | 200 |
| Film thickness [μm] | 3 | * | ** | *** | 0.5 |

*The thickness of the first layer region was obtained by subtracting the thickness of the second and third layer regions from 30 μm.
**The thickness of the second layer region was obtained by subtracting the thickness of the third layer region from the thickness of the layer region that could absorb 90% of 700 nm light.
***The thickness of the third layer region was a thickness sufficient to absorb 70% of 680 nm light. (Samples were measured to obtain absorptivities for 680 nm and 700 nm light)

TABLE 12

| | Charge | Photoconductive layer | | | |
|---|---|---|---|---|---|
| | injection inhibiting layer | First layer region | Second layer region | Third layer region | Surface layer |
| Gas species and flow rate | | | | | |
| $SiH_4$ [sccm] | 200 | 75 | 75 | 75 | 10 |
| $H_2$ [sccm] | 300 | 1000 | 1000 | 1000 | |
| Content of Group IIIb elements relative to silicon atoms [ppm] | 2000 | 2 | 1.5 | 0.3 | |
| NO [sccm] | 5 | | | | |
| $CH_4$ [sccm] | | | | | 500 |
| Support temperature [° C.] | 290 | 290 | 290 | 290 | 280 |
| Pressure [Pa] | 67 | 67 | 67 | 67 | 67 |
| RF power [W] | 500 | 100 | 100 | 100 | 200 |
| Film thickness [μm] | 3 | * | ** | *** | 0.5 |

*The thickness of the first layer region was obtained by subtracting the thickness of the second and third layer regions from 30 μm.
**The thickness of the second layer region was obtained by subtracting the thickness of the third layer region from the thickness of the layer region that could absorb 90% of 700 nm light.
***The thickness of the third layer region was a thickness sufficient to absorb 70% of 680 nm light. (Samples were measured to obtain absorptivities for 680 nm and 700 nm light)

TABLE 13

| | Charge | Photoconductive layer | | | |
|---|---|---|---|---|---|
| | injection inhibiting layer | First layer region | Second layer region | Third layer region | Surface layer |
| Gas species and flow rate | | | | | |
| $SiH_4$ [sccm] | 150 | 200 | 200 | 200 | 200→20→20 |
| $H_2$ [sccm] | 300 | 800 | 800 | 800 | |
| Content of Group IIIb elements relative to silicon atoms [ppm] | 2000 | 10→3 | 2 | 0.5 | |
| NO [sccm] | 5 | | | | |
| $CH_4$ [sccm] | | | | | 50→600→600 |
| Support temperature [° C.] | 280 | 280 | 280 | 280 | 280 |
| Pressure [Pa] | 53 | 67 | 67 | 67 | 67 |
| RF power [W] | 300 | 650 | 650 | 650 | 150 |
| Film thickness [μm] | 3 | * | ** | *** | 0.5 |

*The thickness of the first layer region was obtained by subtracting the thickness of the second and third layer regions from 30 μm.
**The thickness of the second layer region was obtained by subtracting the thickness of the third layer region from the thickness of the layer region that could absorb 80% of 700 nm light.
***The thickness of the third layer region was a thickness sufficient to absorb 80% of 680 nm light. (Samples were measured to obtain absorptivities for 680 nm and 700 nm light)

TABLE 14

| | Charge | Photoconductive layer | | | |
|---|---|---|---|---|---|
| | injection inhibiting layer | First layer region | Second layer region | Third layer region | Surface layer |
| Gas species and flow rate | | | | | |
| $SiH_4$ [sccm] | 150 | 150 | 150 | 150 | 200→10→10 |
| $AiF_4$ [sccm] | 5 | 1 | 1 | 1 | 5 |
| $H_2$ [sccm] | 500 | 600 | 600 | 600 | |
| Content of Group IIIb elements relative to silicon atoms [ppm] | 1500 | 10 | 4→3 | 2→1.2 | 1 |
| NO [sccm] | 10 | 0.1 | 0.1 | 0.1 | 0.5 |
| $CH_4$ [sccm] | 5 | 0.2 | 0.2 | 0.2 | 50→600→700 |
| Support temperature [° C.] | 270 | 260 | 260 | 260 | 250 |
| Pressure [Pa] | 40 | 53 | 53 | 53 | 53 |
| RF power [W] | 200 | 600 | 600 | 600 | 100 |
| Film thickness [μm] | 3 | * | ** | *** | 0.5 |

*The thickness of the first layer region was obtained by subtracting the thickness of the second and third layer regions from 30 μm.
**The thickness of the second layer region was obtained by subtracting the thickness of the third layer region from the thickness of the layer region that could absorb 60% of 700 nm light.
***The thickness of the third layer region was a thickness sufficient to absorb 60% of 680 nm light. (Samples were measured to obtain absorptivities for 680 nm and 700 nm light)

TABLE 15

| | Charge | Photoconductive layer | | | |
|---|---|---|---|---|---|
| | injection inhibiting layer | First layer region | Second layer region | Third layer region | Surface layer |
| Gas species and flow rate | | | | | |
| $SiH_4$ [sccm] | 300 | 300 | 300 | 300 | 20 |
| $H_2$ [sccm] | 300 | 1000 | 1000 | 1000 | |
| Content of Group IIIb elements relative to silicon atoms [ppm] | 3000 | 10→5 | 3→0.3 | 0.2 | |
| NO [sccm] | 5 | | | | |
| $NH_3$ [sccm] | | | | | 500 |
| Support temperature [° C.] | 250 | 250 | 250 | 250 | 250 |
| Pressure [Pa] | 50 | 65 | 65 | 65 | 53 |
| RF power [W] | 300 | 1000 | 1000 | 1000 | 300 |
| Film thickness [μm] | 3 | * | ** | *** | 0.3 |

*The thickness of the first layer region was obtained by subtracting the thickness of the second and third layer regions from 30 μm.
**The thickness of the second layer region was obtained by subtracting the thickness of the third layer region from the thickness of the layer region that could absorb 90% of 700 nm light.
***The thickness of the third layer region was a thickness sufficient to absorb 70% of 680 nm light. (Samples were measured to obtain absorptivities for 680 nm and 700 nm light)

TABLE 16

| | Charge injection inhibiting layer | Photoconductive layer First layer region | Second layer region | Third layer region | Surface layer |
|---|---|---|---|---|---|
| Gas species and flow rate | | | | | |
| $SiH_4$ [sccm] | 150 | 150 | 150 | 150 | 20 |
| $H_2$ [sccm] | 400 | 800 | 800 | 800 | |
| Content of Group IIIb elements relative to silicon atoms [ppm] | 1500 | 7→1 | 0.5 | 0.2 | |
| NO [sccm] | 5 | | | | 10 |
| $CH_4$ [sccm] | | | | | 500 |
| Support temperature [° C.] | 290 | 290 | 290 | 290 | 290 |
| Pressure [Pa] | 55 | 60 | 60 | 60 | 50 |
| RF power [W] | 500 | 600 | 600 | 600 | 200 |
| Film thickness [μm] | 2 | * | ** | *** | 0.5 |

*The thickness of the first layer region was obtained by subtracting the thickness of the second and third layer regions from 30 μm.
**The thickness of the second layer region was obtained by subtracting the thickness of the third layer region from the thickness of the layer region that could absorb 70% of 700 nm light.
***The thickness of the third layer region was a thickness sufficient to absorb 65% of 680 nm light. (Samples were measured to obtain absorptivities for 680 nm and 700 nm light)

TABLE 17

| | Photoconductive layer First layer region | Second layer region | Third layer region | Surface layer |
|---|---|---|---|---|
| Gas species and flow rate | | | | |
| $SiH_4$ [sccm] | 100 | 100 | 100 | 200→50→20 |
| $H_2$ [sccm] | 500 | 500 | 500 | |
| Content of Group IIIb elements relative to silicon atoms [ppm] | 5→1 | 0.2 | 0.1 | |
| $C_2H_2$ [sccm] | 2 | 2 | 2 | 20→200→300 |
| Support temperature [° C.] | 280 | 280 | 280 | 270 |
| Pressure [Pa] | 65 | 65 | 65 | 60 |
| RF power [W] | 400 | 400 | 400 | 300 |
| Film thickness [μm] | * | ** | *** | 0.5 |

*The thickness of the first layer region was obtained by subtracting the thickness of the second and third layer regions from 30 μm.
**The thickness of the second layer region was obtained by subtracting the thickness of the third layer region from the thickness of the layer region that could absorb 75% of 700 nm light.
***The thickness of the third layer region was a thickness sufficient to absorb 55% of 680 nm light. (Samples were measured to obtain absorptivities for 680 nm and 700 nm light)

What is claimed is:

1. An electrophotographic light-receiving member comprising a conductive support; and a light-receiving layer provided on the conductive support and having a photoconductive layer composed of a non-monocrystalline material comprising silicon atoms as a matrix, hydrogen and/or halogen atoms, and an element belonging to Group IIIb of the periodic table, wherein the photoconductive layer has (a) a hydrogen content of 10–30 atomic %, an optical band gap of 1.75–1.85 eV, and a characteristic energy of the Urbach tail obtained from an optical absorption spectrum of 55–65 meV, (b) a hydrogen content of 10–20 atomic %, an optical band gap of 1.65–1.75 eV, and a characteristic energy of the Urbach tail obtained from an optical absorption spectrum of 50–55 meV, or (c) a hydrogen content of 25–40 atomic %, an optical band gap of 1.80–1.90 eV, and a characteristic energy of the Urbach tail obtained from an optical absorption spectrum of 50–55 meV, and wherein the photoconductive layer has from the surface side toward the conductive support side, a third layer region that absorbs 50 to 90% of image exposure light incident on the photoconductive layer, a second layer region that is other than the third layer region of a layer region that absorbs 60 to 90% of pre-exposure light incident on the photoconductive layer, the pre-exposure light having a wavelength larger than the wavelength of the image exposure light, and a first layer region that is other than the third and the second layer regions of the photoconductive layer, wherein the percentage of absorption of the pre-exposure light is not less than the percentage of absorption of the image exposure light, and wherein the content of the element belonging to Group IIIb of the periodic table decreases in the order of the first, the second and the third layer regions and changes such that the contents of the Group IIIb element of two adjoining layer regions are not the same at an interface thereof, and the content of the Group III(b) element in each layer region of the first layer region, the second layer region and the third layer region is (i) constant within the layer region or (ii) varies so as to be greater at the substrate side within the layer region.

2. An electrophotographic light-receiving member according to claim 1, wherein the content of the element belonging to Group IIIb of the periodic table of the third layer region is 0.03–5 ppm relative to the silicon atoms.

3. An electrophotographic light-receiving member according to claim 1, wherein the content of the element belonging to Group IIIb of the periodic table of the second layer region is 0.2–10 ppm relative to the silicon atoms.

4. An electrophotographic light-receiving member according to claim 1, wherein the ratio of the content of the element belonging to Group IIIb of the periodic table of the second layer region to the content of the element belonging to Group IIIb of the periodic table of the third layer region is 1.2–200.

5. An electrophotographic light-receiving member according to claim 1, wherein the content of the element belonging to Group IIIb of the periodic table of the first layer region is 1–25 ppm relative to the silicon atoms.

6. An electrophotographic light-receiving member according to claim 1, wherein the content of the element belonging to Group IIIb of the periodic table of the photoconductive layer is constant within at least one of the first, the second and the third layer regions.

7. An electrophotographic light-receiving member according to claim 1, wherein the content of the element belonging to Group IIIb of the periodic table of the photoconductive layer varies so as to be greater at the substrate side within the layer region in at least one of the first, the second and the third layer regions.

8. An electrophotographic light-receiving member according to claim 1, wherein the photoconductive layer contains at least one selected from the group consisting of carbon, oxygen and nitrogen.

9. An electrophotographic light-receiving member according to claim 1, wherein the photoconductive layer is provided on the surface thereof with a surface layer comprising a non-monocrystalline material comprising silicon atoms as a matrix and at least one selected from the group consisting of carbon, oxygen and nitrogen.

10. An electrophotographic light-receiving member according to claim 9, wherein the surface layer has a thickness of 0.01–3 μm.

11. An electrophotographic light-receiving member according to claim 1, wherein the photoconductive layer is provided on a surface of a charge injection inhibiting layer comprising a non-monocrystalline material comprising silicon atoms as a matrix, hydrogen and/or halogen atoms, at least one selected from the group consisting of carbon, oxygen and nitrogen, and at least one element selected from Group IIIb of the periodic table, and wherein the photoconductive layer is provided on the surface thereof with a surface layer comprising a non-monocrystalline material comprising silicon atoms as a matrix and at least one selected from the group consisting of carbon, oxygen and nitrogen.

12. An electrophotographic light-receiving member according to claim 11, wherein the surface layer has a thickness of 0.01–3 μm.

13. An electrophotographic light-receiving member according to claim 11, wherein the charge injection inhibiting layer has a thickness of 0.1–5 μm.

14. An electro photographic light-receiving member according to claim 11, wherein the photoconductive layer has a thickness of 20–50 μm.

15. An electrophotographic light-receiving member according to claim 1, wherein the photoconductive layer has a thickness of 20–50 μm.

16. An electrophotographic light-receiving member comprising a conductive support; and a light-receiving layer provided on the conductive support and having a photoconductive layer composed of a non-monocrystalline material comprising silicon atoms as a matrix, hydrogen and/or halogen atoms, and an element belonging to Group IIIb of the periodic table, wherein the photoconductive layer has from the surface side toward the conductive support side, a third layer region that absorbs 50 to 90% of image exposure light incident on the photoconductive layer, a second layer region that is other than the third layer region of a layer region that absorbs 60 to 90% of pre-exposure light incident on the photoconductive layer, the pre-exposure light having a wavelength larger than the wavelength of the image exposure light, and a first layer region that is other than the third and the second layer regions of the photoconductive layer, and wherein the content of the element belonging to Group IIIb of the periodic table decreases in the order of the first, the second and the third layer regions and changes such that the contents of Group IIIb element of two adjoining layer regions are not the same at an interface thereof, and the content of the Group IIIb element in each layer region of the first layer region, the second layer region and the third layer region is (i) constant within the layer region or (ii) varies so as to be greater at the substrate side within the layer region.

17. An electrophotographic light-receiving member according to claim 16, wherein the content of the element belonging to Group IIIb of the periodic table of the third layer region is 0.03–5 ppm relative to the silicon atoms.

18. An electrophotographic light-receiving member according to claim 16, wherein the content of the element belonging to Group IIIb of the periodic table of the second layer region is 0.2–10 ppm relative to the silicon atoms.

19. An electrophotographic light-receiving member according to claim 18, wherein the content of the element belonging to Group IIIb of the periodic table of the first layer region is 1–25 ppm relative to the silicon atoms.

20. An electrophotographic light-receiving member according to claim 16, wherein the ratio of the content of the element belonging to Group IIIb of the periodic table of the second layer region to the content of the element belonging to Group IIIb of the periodic table of the third layer region is 1.2–200.

21. An electrophotographic light-receiving member according to claim 16, wherein the content of the element belonging to Group IIIb of the periodic table of the first layer region is 1–25 ppm relative to the silicon atoms.

22. An electrophotographic light-receiving member according to claim 16, wherein the content of the element belonging to Group IIIb of the periodic table of the photoconductive layer is constant within at least one of the first, the second and the third layer regions.

23. An electrophotographic light-receiving member according to claim 16, wherein the content of the element belonging to Group IIIb of the periodic table of the photoconductive layer varies so as to be greater at the substrate side within the layer region in at least one of the first, the second and the third layer regions.

24. An electrophotographic light-receiving member according to claim 16, wherein the photoconductive layer contains at least one selected from the group consisting of carbon, oxygen and nitrogen.

25. An electrophotographic light-receiving member according to claim 16, wherein the photoconductive layer is provided on the surface thereof with a surface layer comprising a non-monocrystalline material comprising silicon atoms as a matrix and at least one selected from the group consisting of carbon, oxygen and nitrogen.

26. An electrophotographic light-receiving member according to claim 25, wherein the surface layer has a thickness of 0.01–3 μm.

27. An electrophotographic light-receiving member according to claim 16, wherein the photoconductive layer is provided on a surface of a charge injection inhibiting layer comprising a non-monocrystalline material comprising silicon atoms as a matrix, hydrogen and/or halogen atoms, at least one selected from the group consisting of carbon, oxygen and nitrogen, and at least one element selected from Group IIIb of the periodic table, and wherein the photoconductive layer is provided on the surface thereof with a surface layer comprising a non-monocrystalline material comprising silicon atoms as a matrix and at least one selected from the group consisting of carbon, oxygen and nitrogen.

28. An electrophotographic light-receiving member according to claim 27, wherein the charge injection inhibiting layer has a thickness of 0.1–5 μm.

29. An electrophotographic light-receiving member according to claim 27, wherein the surface layer has a thickness of 0.01–3 μm.

30. An electrophotographic light-receiving member according to claim 16, wherein the photoconductive layer has a thickness of 20–50 μm.

* * * * *

UNITED STATES PATENT AND TRADEMARK OFFICE

CERTIFICATE OF CORRECTION

PATENT NO. : 6,294,299 B2
DATED : September 25, 2001
INVENTOR(S) : Shinji Tsuchida et al.

It is certified that error appears in the above-identified patent and that said Letters Patent is hereby corrected as shown below:

Column 1,
Line 19, "affection for" should read -- effect on --; and
Line 45, "characteriaticsthe" should read -- characteristics --.

Column 5,
Line 11, "t" should read -- % --; and
Line 36, "hv" should read -- h$\nu$ --.

Column 6,
Line 16, "Joining" should read -- joining --; and
Line 29, "photosensitive-member" should read -- photosensitive member --.

Column 8,
Line 50, "remain" should read -- that remain --.

Column 10,
Line 62, "is consisted" should read -- consists --.

Column 11,
Line 6, "is" should be deleted;
Line 7, "consisted" should read -- consists --; and
Line 18, "is consisted" should read -- consists --.

Column 13,
Line 66, "garium" should read -- gallium --.

Column 16,
Line 18, "t" should read -- % --.

Column 18,
Line 7, "garium" should read -- gallium --; and
Line 51, "provided" should read -- provide --.

UNITED STATES PATENT AND TRADEMARK OFFICE

CERTIFICATE OF CORRECTION

PATENT NO. : 6,294,299 B2
DATED : September 25, 2001
INVENTOR(S) : Shinji Tsuchida et al.

It is certified that error appears in the above-identified patent and that said Letters Patent is hereby corrected as shown below:

Column 19,
Line 27, "to" should be deleted; and
Line 49, "receives" should be deleted.

Column 20,
Line 11, "garium" should read -- gallium --.

Column 22,
Line 27, "Kg/cm$^2$." should read -- kg/cm$^2$. --.

Column 23,
Line 13, "sheeth-like" should read -- sheath-like --; and
Line 22, "hearing" should read -- heating --.

Column 24,
Line 43, "was" should read -- that was --.

Column 33,
Line 53, "90t" should read -- 90% --.

Column 37,
Line 44, "(D)" should read -- ¶ (D) --.

Column 40,
Line 56, "with" should read -- layer with --.

Column 46,
Table 14, "$AiF_4$" should read -- $SiF_4$ --.

UNITED STATES PATENT AND TRADEMARK OFFICE

CERTIFICATE OF CORRECTION

PATENT NO. : 6,294,299 B2
DATED : September 25, 2001
INVENTOR(S) : Shinji Tsuchida et al.

It is certified that error appears in the above-identified patent and that said Letters Patent is hereby corrected as shown below:

Column 49,
Line 20, "electro photographic" should read -- electrophotographic --.

Signed and Sealed this

First Day of October, 2002

*Attest:*

*Attesting Officer*

JAMES E. ROGAN
*Director of the United States Patent and Trademark Office*